US006297437B1

(12) United States Patent
Ura et al.

(10) Patent No.: US 6,297,437 B1
(45) Date of Patent: Oct. 2, 2001

(54) KEYBOARD MUSICAL INSTRUMENT AND INFORMATION PROCESSING SYSTEM INCORPORATED THEREIN FOR DISCRIMINATING DIFFERENT KINDS OF KEY MOTION

(75) Inventors: Tomoyuki Ura; Tsutomu Sasaki, both of Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/394,805

(22) Filed: Sep. 20, 1999

(30) Foreign Application Priority Data

Sep. 18, 1998 (JP) ..... 10-265533

(51) Int. Cl.[7] ..... G10C 3/12

(52) U.S. Cl. ..... 84/423 R; 84/18; 84/439; 84/462; 84/DIG. 7

(58) Field of Search ..... 84/461–462, 423 R, 84/439–440, 16–21, 65–67, 600–602, 615–616, 653–654, 718–720, 743–745, DIG. 7

(56) References Cited

U.S. PATENT DOCUMENTS 5,451,708 * 9/1995 Fujiwara et al. ..... 84/21
5,583,310 * 12/1996 Sugiyama et al. ..... 84/719
5,804,816 * 9/1998 Yamamoto et al. ..... 250/221
5,824,930 10/1998 Ura et al. ..... 84/462
6,051,762 * 4/2000 Fujiwara et al. ..... 84/21

FOREIGN PATENT DOCUMENTS 9-54584 2/1997 (JP) .

* cited by examiner

*Primary Examiner*—Marlon T. Fletcher
(74) *Attorney, Agent, or Firm*—Morrison & Foerster

(57) ABSTRACT

A keyboard musical instrument includes an acoustic piano for generating acoustic tones, a silent system for rebounding the hammer assemblies between the escape from the key action mechanisms and strikes against strings and automatic playing system for actuating the key action mechanisms without fingering, and the automatic playing system generates electronic tones on the basis of the key motions monitored by associated key sensors, wherein the space between the rest position and the end position is divided into plural sections, and a controller calculates a key velocity in each of the plural sections so as to exactly determine the key motion, thereby improving the fidelity of the electronic sounds to the key motion.

13 Claims, 24 Drawing Sheets

| | En | RnH | RnL |
|---|---|---|---|
| 0 | | | |
| 1 | | | |
| 2 | | | |
| 3 | | KEY STATE | CURRENT KEY POSITION |
| 4 | | | COLUMN NUMBER OF TONE GENERATION TABLE |
| 5 | A/D CONVERSION TIME | | KEY NUMBER |
| 6 | TIMER | | A/D CHANNEL |

FIG. 14

KEYBOARD MUSICAL INSTRUMENT AND INFORMATION PROCESSING SYSTEM INCORPORATED THEREIN FOR DISCRIMINATING DIFFERENT KINDS OF KEY MOTION

FIELD OF THE INVENTION

This invention relates to a keyboard musical instrument and, more particularly, to a keyboard musical instrument with an information processing system for processing pieces of data representative of key motions.

DESCRIPTION OF THE RELATED ART

Various kinds of keyboard musical instrument are sold in the market. An acoustic piano, an electric keyboard and a compromise therebetween are typical examples of the keyboard musical instrument. A player gives his instructions for a piece of music to the acoustic piano through the black keys and the white keys, and the strings generate the acoustic sounds upon strikes with the hammers. Thus, player's instructions are mechanically transferred to the strings. A player also gives his instructions for a piece of music to the electric keyboard through the black keys and the white keys. However, the black keys and the white keys are not mechanically connected to a sound system such as a speaker system. The electric keyboard has an array of key switches. The key switches interpret the player's instructions, and convert the instructions to electric signals.

An automatic player piano is a kind of compromise. The automatic player piano is an acoustic piano equipped with key sensors and solenoid-operated key actuators. While a player is fingering a piece of music on the keyboard, the action mechanisms drive the hammers for rotation so as to strike the strings, and the strings vibrate for generating the acoustic sounds. The key sensors monitor the key motions, and interpret player's instructions for the piece of music. The key sensors converts the player's instructions to electric signals, and the player's instructions are electrically or magnetically stored in a suitable information storage.

Another example of the compromise is known as "silent piano". The silent piano is disclosed in Japanese Patent Publication of Unexamined Application No. 9-54584. The silent piano is an acoustic piano equipped with a hammer stopper and an electronic sound generating system. If the hammer stopper is outside of the hammer's trajectories, the action mechanisms drive the hammers for rotation, and the hammers strike the strings for generating the acoustic sounds. When the player changes the hammer stopper into the trajectories of the hammers, the hammers rebound on the hammer stopper before the strike at the strings, and any acoustic sound is generated. However, the key sensors monitor the key motions. The key sensors interpret the player's instructions, and convert them to electric signals. The electric signals are supplied to a tone generator. The tone generator tailors an audio signal, and a suitable sound system such as a headphone generates electronic sounds from the audio signal. Thus, the key sensors are indispensable in the compromise and the electric keyboard.

FIG. 1 illustrates detecting points of a key sensor provided on a trajectory of a black/white key incorporated in the silent piano disclosed in the Japanese Patent Publication of Unexamined Application. "REST" and "END" are indicative of a rest position and an end position. The key is staying at the rest position without any force exerted thereon. When a player depresses the key, the key starts a motion at the rest position. The player's finger sinks together with the key, and the key does not go further. Then, the key reaches the end position.

A player puts his finger on the black/white key, and pushes the black/white key from the rest position to the end position. The black/white key is not spaced from the finger, and stops at the end position. The key motion without separation from the finger is hereinbelow referred to as "ordinary key motion". The black/white key is moved along a trajectory TR1. The trajectory TR1 is approximated to a parabola.

A key sensor is provided for the black/white key, and varies a key position signal varied at detecting points K1, K2, K3 and K4. The key position signal is supplied to a controller, and the controller memorizes arrival times at the detecting points K1, K2, K3 and K4. The controller averages the key velocity in the key motion between the detecting point K2 and the detecting point K4, and determines the key velocity on the basis of the averaged key motion. The key motion between the detecting point K1 and the detecting point K2 is not taken into account, because it does not affect the hammer velocity at the strike.

FIG. 2 illustrates another kind of key motion, which the Japanese Patent Publication of Unexamined Application did not take into account. If a player brings his finger down on the black/white key, the finger strongly hits the black/white key, and the black/white key starts a free motion toward the end position. This means that the black/white key is separated from the finger after the hit. The black/white key is moved on a trajectory TR2, and the trajectory TR2 has a step A1 between two straight portions TR2*a* and TR2*b*. The step A1 is due to viscoelasticity of the felt and the cloth forming parts of the associated action mechanism. The trajectory TR2 is representative of the key motion initiated with the finger brought down on the black/white key, and the key motion is hereinbelow referred to as "abrupt key motion".

Even if a black/white key starts the abrupt key motion, the controller averages the abrupt key motion between the detecting point K2 and the detecting point K4, and stores the key velocity of the averaged key motion as the key velocity corresponding to the final hammer velocity. However, the key velocity calculated from the averaged key motion is smaller than the key velocity proportional to the final hammer velocity. As a result, the electronic sound is smaller in loudness than an electronic sound to be produced. Thus, the prior art silent piano can not exactly control the loudness of the electronic sound in the abrupt key motion.

If the key sensor and the controller are incorporated in the prior art automatic player piano, the prior art automatic player piano does not exactly reproduce the acoustic sound in the playback, because the solenoid-operated key actuator does not hit the black/white key, but pushes it.

SUMMARY OF THE INVENTION

It is therefore an important object of the present invention to provide a keyboard musical instrument, which exactly controls the loudness of a sound for the abrupt key motion.

It is also an important object of the present invention to provide an information processing system, which distinguishes different kinds of key motion.

In accordance with one aspect of the present invention, there is provided a keyboard musical instrument comprising manipulators movable through a space divided into sections between respective rest positions of the manipulators and respective end positions of the manipulators, sensors respectively provided for the manipulators and measuring trajectories of the associated manipulators in the sections, a controller connected to the sensors and calculating a section velocity of each of the manipulators in each of the sections so as to determine the trajectory of each manipulator to be categorized in one of kinds of the motions of the manipulators on the basis of the values of the section velocity respectively calculated in the sections and a tone generator connected to the controller and regulating an attribute of a sound to be produced in response to each manipulator to an appropriate value depending upon the one of the kinds of the trajectories.

In accordance with another aspect of the present invention, there is provided an information processing system for categorizing a motion of a manipulator into one of predetermined kinds of motions comprising a data storage means for storing first pieces of data information representative of values of a section velocity of manipulators of a musical instrument measured in sections of a space between rest positions of the manipulators and end positions of the manipulators and a means for determining a motion of each of the manipulators to be categorized in one of kinds of motions on the basis of variation of the values of the section velocity.

BRIEF DESCRIPTION OF THE DRAWINGS

The features and advantages of the keyboard musical instrument and the information processing system will be more clearly understood from the following description taken in conjunction with the accompanying drawings in which:

FIG. 14 is a view showing internal register array incorporated in a central processing unit;

DESCRIPTION OF THE PREFERRED EMBODIMENT

Figure 1:
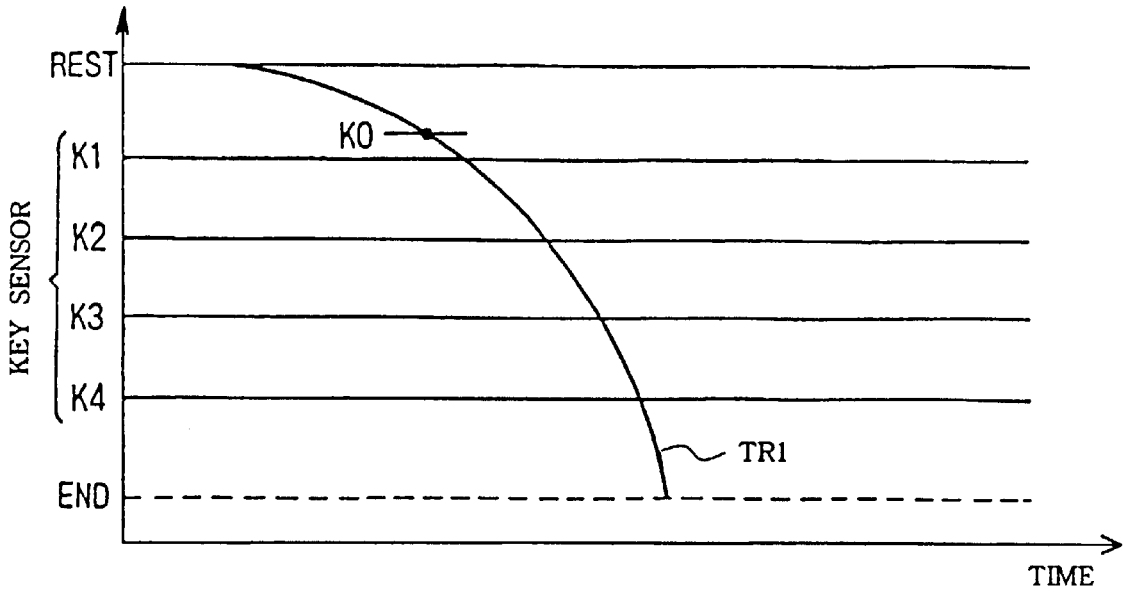
FIG. 1 PRIOR ART
FIG. 1 is a graph showing the detecting points of the key sensor on the trajectory of the black/white key incorporated in the prior art silent piano.

An automatic player piano with a silencer embodying the present invention largely comprises an acoustic upright piano 1, a silent system 20 and an automatic playing system 30. A player fingers a piece of music on the acoustic upright piano 1, and the acoustic upright piano 1 generates acoustic sounds for the piece of music. The silent system 20 permits the player to finger the piece of music without the acoustic sounds, and generates electronic sounds in response to the fingering. The automatic playing system 30 records the performance, and reproduces the performance without the fingering of the player. In the following description, word "front" is indicative of a relative position closer to a player than a "rear" position, and the direction between the front position and the rear position is modified by using word "longitudinal". The lateral direction is perpendicular to the longitudinal direction.

Acoustic Upright Piano

The acoustic upright piano 1 includes a keyboard 3. The keyboard 3 is placed on the key bed 4*a*, and includes black keys 3*a* and white keys 3*b*, a front rail 3*c*, a balance rail 3*d* and a back rail 3*e*. The front rail 3*c*, the balance rail 3*d* and the back rail 3*e* laterally extend in parallel on the key bed 4*a*, and are spaced from one another in the longitudinal direction. The black keys 3*a* and the white keys 3*b* are laid out on the well-known pattern, and are independently turnable around the balance rail 3*d*. Notes of a scale are assigned to the black/white keys 3*a*/3*b*. Balance pins 3*f* keep the black keys 3*a* and the white keys 3*b* at the right positions. In this instance, eighty-eight black/white keys 3*a*/3*b* are incorporated in the keyboard 3, and key numbers "1", "2", . . . and "88" are assigned to the black/white keys 3*a*/3*b*, respectively. For this reason, the notes of the scale are specified by using the key numbers.

While any force is not exerted on the black keys 3*a* and the white keys 3*b*, the black keys 3*a* and the white keys 3*b* sink their rear ends on the back rail cloth adhered to the back rail 3*e*, and are staying in the rest positions, respectively. When a player depresses the black/white keys 3*a*/3*b*, the black/white keys 3*a*/3*b* are driven for rotation in the counter clockwise direction, and reach end positions, respectively. Capstan screws 3*g* project from the rear end portions of the black/white keys 3*a*/3*b*.

The acoustic upright piano 1 further comprises key action mechanisms 5, hammers 6 and sets of strings 7. The key action mechanisms 5 are associated with the black/white keys 3*a*/3*b*, respectively, and the capstan screws 3 g transfer the key motions to the key action mechanisms 5, respectively. The hammers 6 are connected to the key action mechanisms 6, respectively, and are driven for rotation. The hammer 6 strikes the associated set of strings 7, and rebounds thereon. The key action mechanisms 5 give the unique key touch to the fingers of the player as will be described hereinlater in detail.

Figure 4:
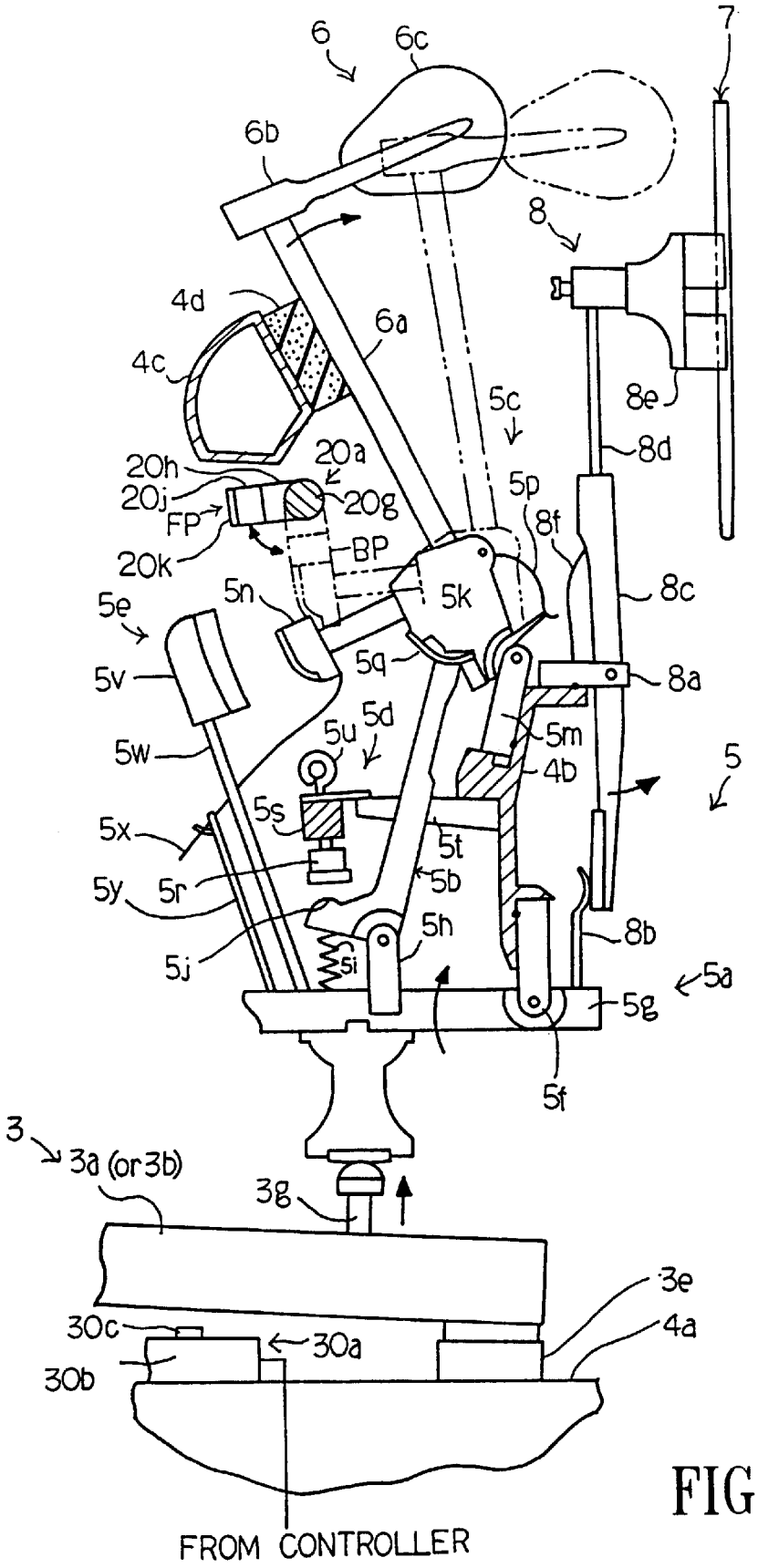
Fig. 4 is a side view showing a key action mechanism incorporated in the automatic player piano.

FIG. 4 illustrates the key action mechanism 5. The key action mechanism 5 is broken down into a whippen assembly 5*a*, a jack 5*b*, a butt assembly 5*c*, a regulating button assembly 5*d* and a back-check 5e. The hammer 6 is fixed to the butt assembly 5*c*. A center rail 4*b* laterally extend over the keyboard 3, and action brackets (not shown) support the center rail 4*b* over the key bed 4*a*. The whippen assembly 5*a* and the butt assembly 5*c* are turnably supported by the center rail 4*b*, and the regulating button assembly 5*d* is fixed to the center rail 4*b*. The jack 5*b* and the back-check 5*e* are mounted on the whippen assembly 5*a*, and turn together with the whippen assembly 5*a*. The jack 5*b* is rotatably supported by the whippen assembly, and drives the butt assembly 5*c* for rotation. When the jack 5*b* is brought into contact with the regulating button assembly 5*d* during the rotation together with the whippen assembly 5*a*, the reaction is exerted on the jack 5*b*, and causes the jack 5*b* to turn so as to drive the butt assembly 5*c* for rotation. Thus, the jack 5*b* escapes from the butt assembly 5*c*, and gives the unique key touch to the finger of the player. The butt assembly 5*c* is linked with the back-check 5*e,* and prevents the set of strings 7 from double strike with the hammer 6.

The whippen assembly 5*a* has a whippen flange 5*f*, a whippen 5*g* and a jack flange 5*h*. The whippen flange 5*f* is fixed to the rear surface of the center rail 4*b*, and downwardly projects therefrom. The rear end portion of the whippen 5*g* is turnably connected to the whippen flange 5*f*, and the capstan screw 5*g* is held in contact with the lower surface of the whippen 5*g*. The jack flange 5*h* is fixed to the intermediate portion of the whippen 5*f*, and upwardly projects therefrom. While the associated black/white key 3*a*/3*b* is staying in the rest position, the capstan screw 3 g keeps the whippen 5*g* substantially horizontal. The whippen 5*g* is rotated in the clockwise direction around the whippen flange 5*f* during the upward motion of the capstan screw 3 g and, accordingly, the motion of the associated key 3*a*/3*b* from the rest position toward the end position. The self-weight permits the whippen assembly 5*a* to turn around the whippen flange 5*f* in the counter clockwise direction after the release of the black/white key 3*a* / 3*b*.

The jack 5*b* is turnably supported by the jack flange 5*h*, and a jack spring 5*i* urges the jack 5*b* to turn in the clockwise direction. The jack 5*b* is like the mirror writing of an L-letter. The jack 5*b* has a toe 5*j* at the leading end of the short portion, and is held in contact with the butt assembly 5*c* at the leading end of the long portion thereof. The regulating button assembly 5*d* is located over the toe 5*j*. When the toe 5*j* is brought into contact with the regulating button assembly 5*d*, the reaction causes the jack 5*b* to turn around the jack flange 5*h*, and the jack 5*b* escapes from the butt assembly 5*c*. The jack 5*b* kicks the butt assembly 5*c* at the escape, and the butt assembly 5*c* and the hammer 6 start the free rotation toward the associated set of strings 7.

The butt assembly 5*c* has a butt 5*k*, a butt flange 5m, a catcher 5*n*, a butt spring 5*p* and a butt skin 5*q*. The hammer 6 and the catcher 5*n* are fixed to the butt 13*k*, and project in different directions. The butt 5*k* is turnably connected to the butt flange 5*m*, and the butt flange 5*m* is fixed to the front surface of the center rail 4*b*. The butt flange 5*m* keeps the butt 5*k* over the jack 5*b*, and the butt skin 5*q* is attached to a lower surface of the butt 5*k*. While the black/white key 3*a*/3*b* is in the rest position, the jack 5*b* is held in contact with the butt skin 5*q*. The toe 5*j* is brought into contact with the regulating button assembly 5*d* during the key motion from the rest position toward the end portion. Then, the jack 5*b* quickly turns around the jack flange 5*h*, and gives rise free rotation of the butt 5*k* and, accordingly, the hammer 6 in the clockwise direction around the butt flange 5*m*.

While the capstan screw 3*g* is pushing the whippen 5*g*, the load against the key motion is the total self-weight of the whippen assembly 5*a*, the jack 5*b*, the butt assembly 5*c* and the hammer 6, and the player feels the load at his finger heavy. When the toe 5*j* is brought into contact with the regulating button mechanism 5*d*, the reaction makes the jack 5*b* turn in the counter clockwise direction around the jack flange 5*h*, and the jack 5*b* escapes from the butt 5*k*. The contact between the tow 5*j* and the regulating button assembly 5*c* gives rise to increase the load at the player's finger, and the load is suddenly eliminated from the player's finger at the escape. Thus, the key action mechanism 5 generates the unique key touch.

The regulating button assembly 5*d* has a regulating button 5*r*, a regulating rail 5*s*, a folk screw 5*t* and a screw 5*u*. The folk screw 5*t* is fixed to the front surface of the center rail 4*b*, and supports the regulating rail 5*s* over the toe 5*j*. The regulating rail 5*s* laterally extends over the keyboard 3. The regulating button 5*r* is fixed to the screw 5*u*, and the screw 5*u* is hung from the regulating rail 5*s*. The distance between the regulating rail 5*s* and the regulating button 5*r* is regulable, and, accordingly, the gap between the toe 5*j* and the regulating button 5*r* is also regulable. This means that a tuner can change the timing at which the toe 5*j* is brought into contact with the regulating button 5*r*. Thus, the escape timing is varied by regulating the gap.

The back-check 5*e* has a back check block 5*v* supported by a back check wire 5*w* over the front end portion of the whippen 5*g*. The back check block 5*v* intersects the trajectory of the catcher 5*n*, and a bridle tape 5*x* is connected between the catcher 5*n* and a bridle wire 5*y*. The bridge wire 5*y* projects from the front end portion of the whippen 5*g*. After the escape, the butt 5*k*, the catcher 5*n* and the hammer 6 are moved toward the set of strings 7, and the hammer 6 rebounds on the set of strings 7. Then, the butt, 5*k*, the catcher 5*n* and the hammer 6 starts to turn in the counter clockwise direction around the butt flange 5*m*. As described hereinbefore, the back check block 5*v* is linked with the catcher 5*n* by means of the bridle tape 5*x*, and the back check block 5*v* is on the trajectory of the catcher 5*n*. For this reason, the back check block 5*v* receives the catcher 5*n*. When the player releases the black/ white key 3*a*/3*b*, and the whippen 5*g* slightly turns in the counter clockwise direction around the whippen flange 5*f*. Then, the jack 5*b* slides into the lower space of the butt 5*k*. Thus, the bridle tape 5*x* links the whippen assembly 5*a* with the butt assembly 5*c*, and prevents the set of strings 7 from double strike.

A hammer shank 6*a*, a hammer wood 6*b* and a hammer felt 6*c* form in combination each of the hammers 6. The hammer shank 6*a* is fixed to the butt 5*k*, and projects therefrom. The hammer wood 6*b* is fixed to the leading end of the hammer shank 6*a*, and supports the hammer top felt 6c. A hammer rail 4c laterally extends over the key action mechanisms 5, and a hammer rail cloth 4d is fixed to the rear surface of the hammer rail 4c. The hammer shank 6a is resting on the hammer rail cloth 4d before depressing the associated black/white key 3a/3b. When the player depresses the associated black/ white key 3a/3b, the hammer 6 turns together with the butt 5k as described hereinbefore. Upon striking the set of strings 7, the hammer 6 rebounds, and returns toward the hammer rail clothe 4d. Although the back-check 5v receives the catcher 5n, the hammer shank 6a is softly landing on the hammer rail cloth 4d thereafter.

The acoustic piano 1 further comprises damper mechanisms 8. The damper mechanisms 8 are respectively associated with the sets of strings 7, and are linked with the key action mechanisms 5, respectively. The damper mechanisms 8 are spaced from the sets of strings 7 before the strike with the hammers 6, and are brought into contact with the sets of strings for damping the vibrations of the strings.

Each of the damper mechanisms 8 includes a damper flange 8a, a damper spoon 8b, a damper lever 8c, a damper wire 8d, a damper head 8e and a damper spring 8f. The damper flange 8a is fixed to an upper surface of the center rail 4b, and turnably supports the damper lever 8c. The damper spoon 8b is fixed to the rear end portion of the whippen 5g, and projects therefrom. The damper wire 8d is fixed to the damper lever 8c, and the damper head 8e is fixed to the leading end of the damper wire 8d. The damper spring 8f urges the damper lever 8c to turn in the clockwise direction at all times. As a result, the damper lever 8c is held in contact with the damper spoon 8b at the lower end thereof, and the damper head 8e is pressed against the set of strings 7.

While the player is depressing the black/white key 3a/3b from the rest position toward the end position, the capstan screw 3g upwardly pushes the whippen 5g, and the whippen 5g turns in the clockwise direction. Then, the damper spoon 8b declines, and pushes the lower portion of the damper lever 8c against the elastic force of the damper spring 8f. The damper lever 8c turns around the damper flange 8a in the counter clockwise direction, and the damper head 8e is spaced from the set of strings 7. The whippen 5g spaces the damper head 8e before the escape, and the set of strings 7 becomes ready for vibration.

When the player releases the depressed key 3a/3b, the whippen 5 g turns in the counter clockwise direction due to the self-weight, and the damper spring 8f makes the damper lever 8c turn in the clockwise direction. The damper head 8e is brought into contact with the set of vibrating strings 7 on the way to the rest position of the black/white key 3a/3b, and takes up the vibrations.

Thus, the acoustic upright piano 1 generates the acoustic sounds during the fingering a piece of music, and the behavior is similar to a standard upright piano. Although the acoustic upright piano is equipped with pedal mechanisms such as a damper pedal mechanism and a soft pedal mechanism, they are not shown in FIGS. 3 and 4 for the sake of simplicity.

Silent System

Figure 3:
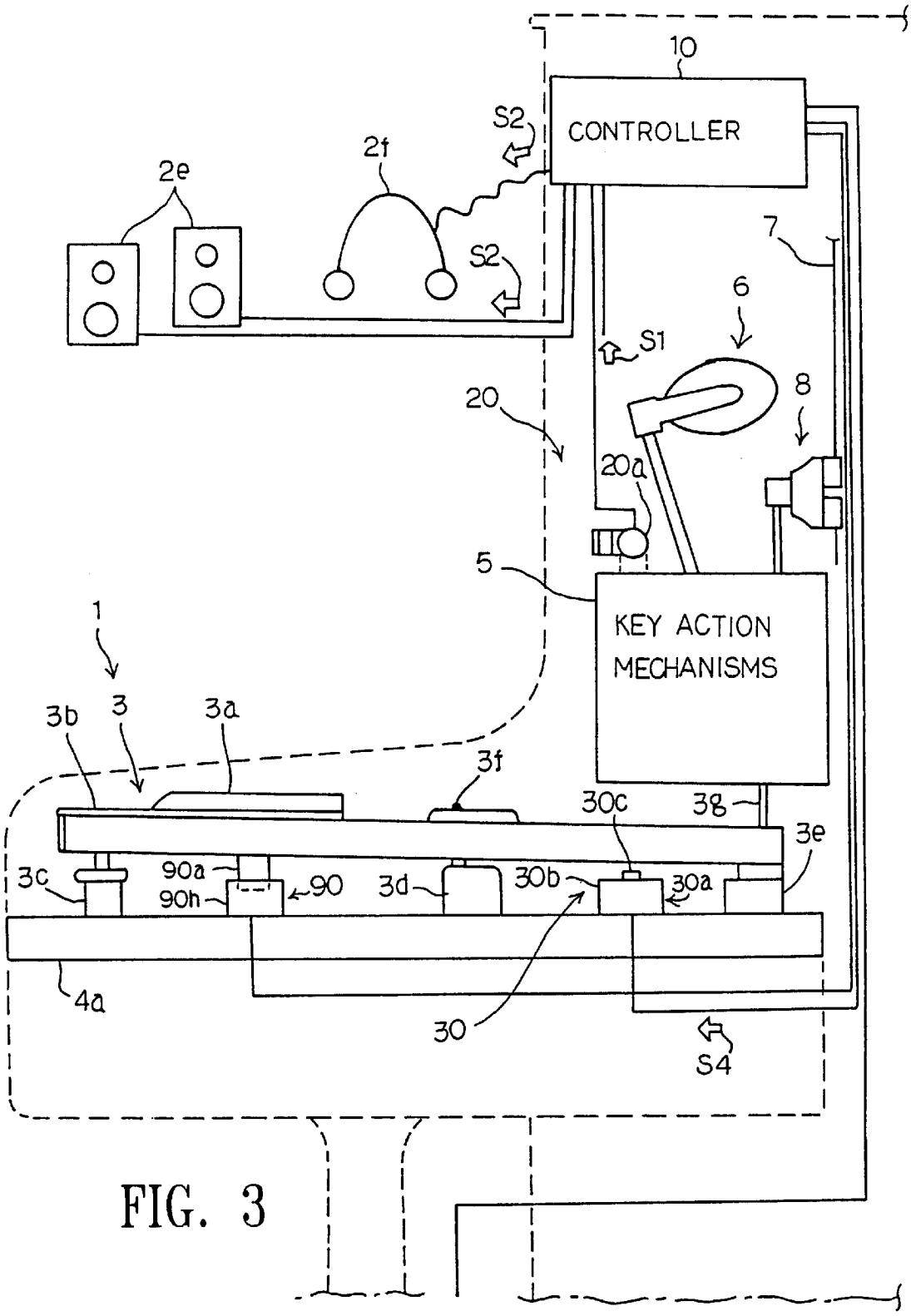
FIG. 3 is a side view showing the structure of an automatic player piano equipped with a silencer according to the present invention.
Figure 5:
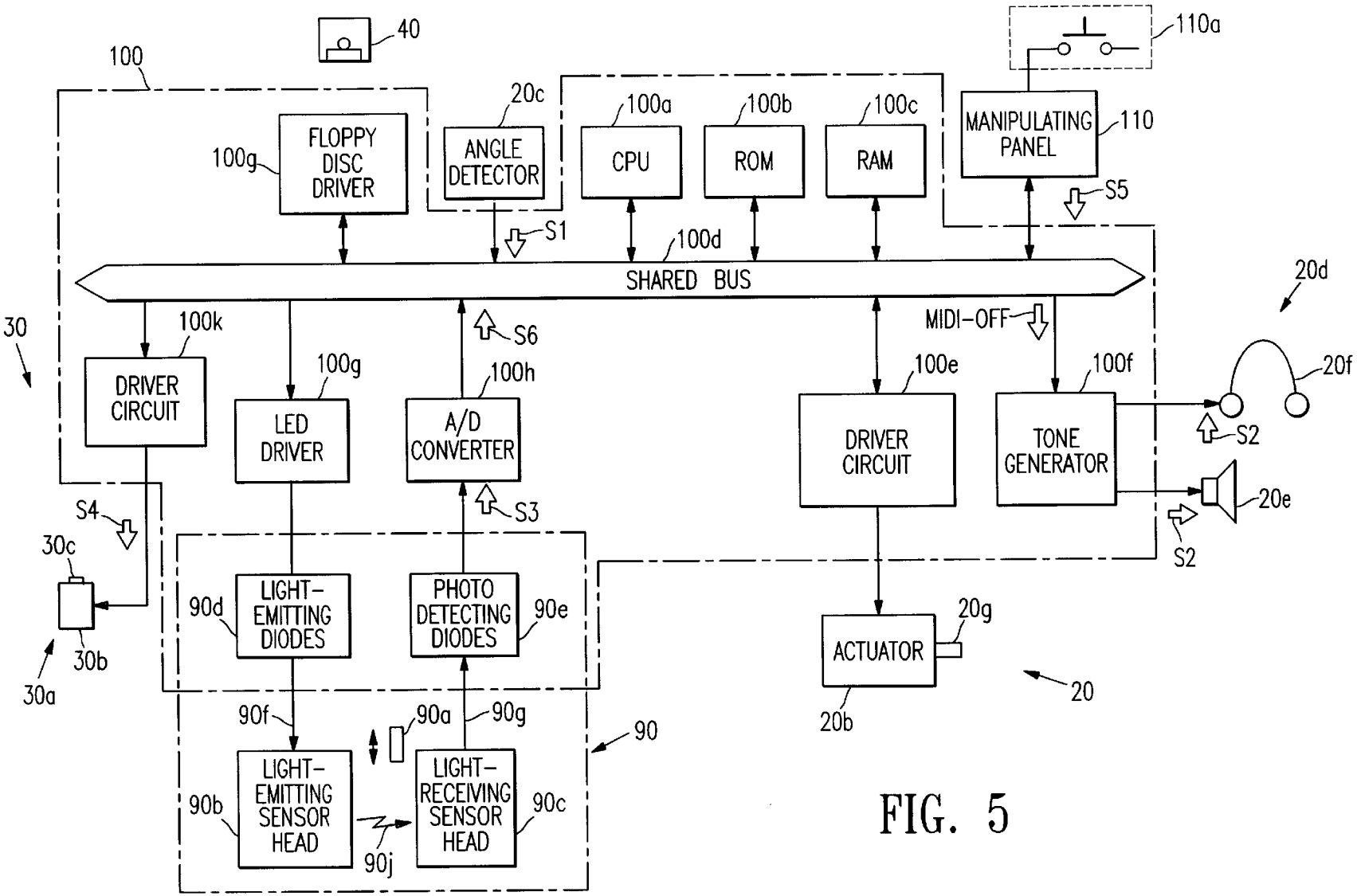
FIG. 5 is a block diagram showing the arrangement of components of an automatic playing system.

Description is hereinbelow made on the silent system 20 with concurrent reference to FIGS. 3, 4 and 5 of the drawings. The silent system 20 includes a catcher stopper 20a, an actuator 20b, an angle detector 20c, key sensors 90, a controller 100, a manipulating panel 110 and a sound system 20d such as a speaker system 20e and a headphone 20f. The key sensors 90, the controller 100 and the manipulating panel 110 are shared between the silent system 20 and the automatic playing system 30. A push button switch 110a is incorporated in the manipulating panel 110.

The key sensor 90 is implemented by the combination of a shutter plate 90a, a light-emitting sensor head 90b, a light-receiving sensor head 90c, a light-emitting diode 90d, a photo-detecting diode 90e and optical fibers 90f/90g. The shutter plate 90a is attached to the lower surface of the black/white key 3a/ 3b, and the light-emitting sensor head 90b and the light-receiving sensor head 90c are accommodated in a sensor case 90h mounted on the key bed 4a as shown in FIG. 3. The light-emitting sensor head 90b is spaced from the light-receiving sensor head 90c, and the shutter plate 90a is moved into and out of the gap between the light-emitting, sensor head 90b and the light-receiving sensor head 90c. The key sensor 90 will be hereinlater described in detail.

The catcher stopper 20a has a shaft 20g, plural brackets 20h, cushion members 20j and protective layers 20k. The shaft 20g is rotatably supported by the action brackets (not shown), and laterally extends over the catchers 5n. The brackets 20h are fixed to the shaft 20g at intervals, and the cushion members 20j are respectively fixed to the brackets 20h, respectively. The cushion members 20j are respectively covered with the protective layers 20k. The actuator 20b is connected to the shaft 20g, and rotates the catcher stopper 20a between a free position FP and a block position BP. The catcher stopper 20a in the free position FP is expressed by real lines, and is outside the trajectories of the catchers 5n. On the other hand, the catcher stopper 20a in the block position BP is expressed by dots-and-dash lines, and the cushion members 20j covered with the protective layers 20k are on the trajectories of the catchers 5n. The angle detector 20c is provided in association with the actuator 20a or the catcher stopper 20a, and generates a stopper position signal S1 indicative of a current angular position of the catcher stopper 20a to the controller 100.

The catcher stopper 20a is assumed to be in the free position FP. When the player pushes the push button switch 110a, the controller 100 energizes the actuator 20b, and the actuator 20b rotates the shaft 20g in the counter clockwise direction. The angle detector 20c monitors the rotation, and varies the stopper position signal S1. The controller 100 checks the stopper position signal S1 to see whether the catcher stopper 20a reaches the block position BP. When the current angular position is consistent with the block position BP, the controller 100 removes the electric power from the actuator 20b, and the catcher stopper 20a stops at the block position BP.

After the change of the catcher stopper 20a to the block position, the player is assumed to start the fingering on the keyboard 3. The black/white keys 3a/3b are selectively depressed, and are, thereafter, released. When the player depresses a black/white key 3a/3b, the capstan screw 3g pushes the whippen 5g, and rotates the whippen 5g around the whippen flange 5f in the clockwise direction. The jack 5b is rotated together with the whippen 5g, and the toe 5j is getting closer and closer to the regulating button 5r. The jack 5b pushes the butt 5k, and slowly rotates the butt 5k and the hammer 6 around the butt flange 5m in the clockwise direction. When the toe 5j is brought into contact with the regulating button 5r, the jack 5b turns around the jack flange 5h in the counter clockwise direction, and escapes from the butt 5k. The butt 5k and the hammer 6 start the free rotation at the escape, and the player feels the key touch usual. However, the catcher 5n is brought into contact with the catcher stopper 2a before the hammer top felt 6c strikes the set of strings 7. The catcher 5n rebounds on the catcher stopper 20a, and any acoustic sound is generated through the vibrations of the set of strings 7. The key sensor 90 monitors the key motion, and the controller 100 specifies the depressed black/white key 3*a*/3*b*. The controller 100 discriminates the kinds of key motion, and accurately estimates the final hammer velocity as will be described hereinlater in detail. The controller 100 supplies an audio signal S2 to the speaker system 20*e* and/or the headphone 20*f*, and the speaker system 20*e* and/or the headphone 20*f* generates electronic sound at an appropriate loudness.

If the player pushes the push button switch 110*a*, again, the controller 100 changes the polarity of the electric power, and the actuator 20*b* inversely rotates the shaft 20*g*. The angle detector 20*c* varies the current angular position represented by the stopper position signal S1, and the controller 100 compares the current angular position with the free position FP to see whether or not the catcher stopper 20*a* reaches the free position FP. When the current angular position is consistent with the free position FP, the controller 100 instructs the actuator 20*b* to stop the shaft 20*g*. After the entry into the free position FP, the catchers 5*n* do not reach the catcher stopper 20*g*, and the player fingers the piece of music on the keyboard 3 without interruption of the catcher stopper 20*a*. As a result, the acoustic sounds are generated from the sets of strings 7.

Figure 6:
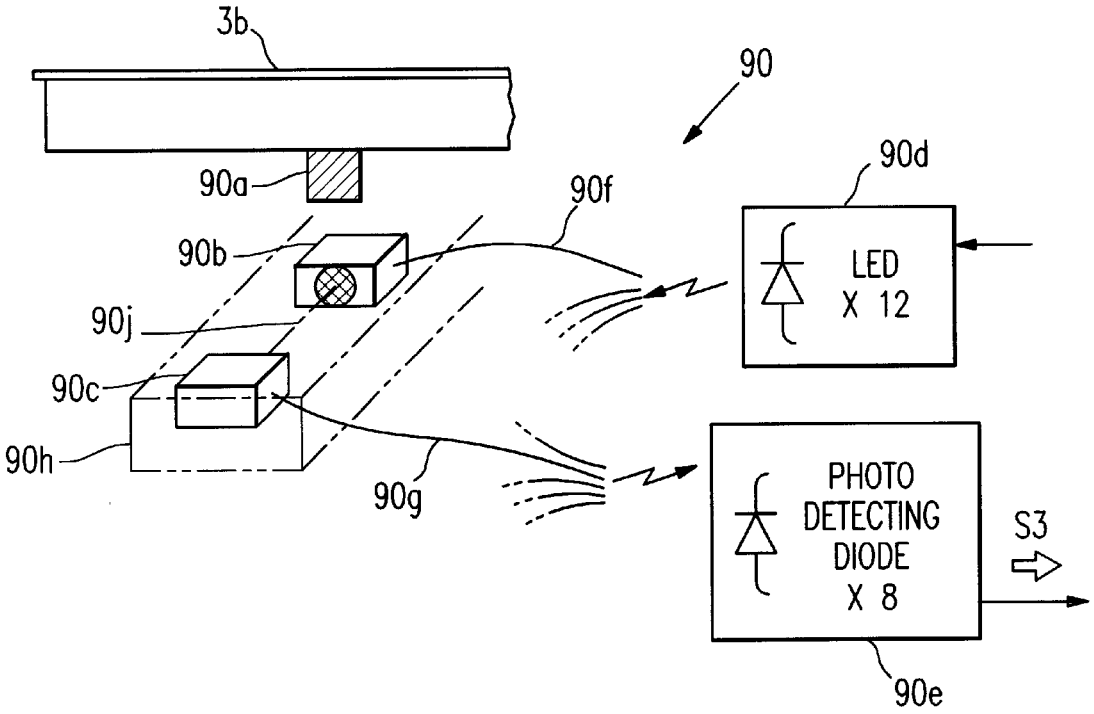
FIG. 6 is a perspective view showing a key sensor incorporated in the automatic player piano.
Figure 7:
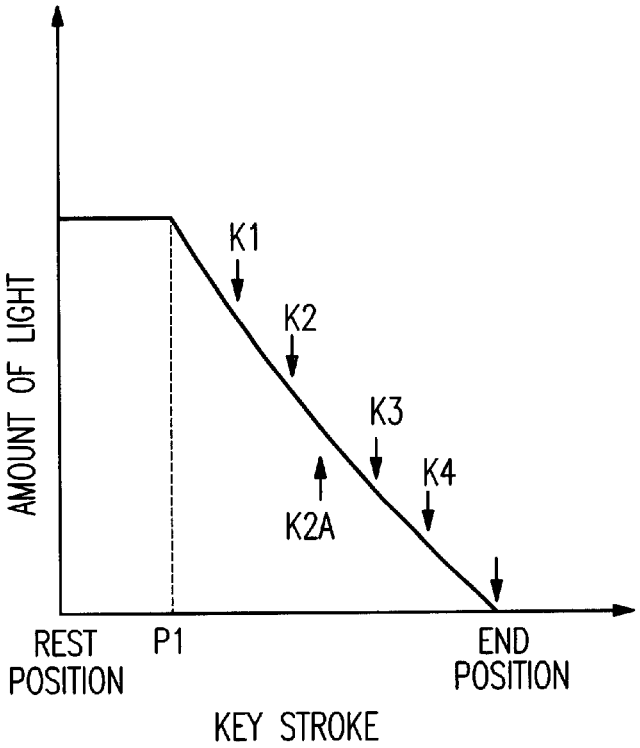
FIG. 7 is a graph showing relation between a key position and the amount of light at a light-receiving sensor head.

The key sensor 90 is illustrated in detail in FIG. 6. The light-emitting sensor head 90*b* is connected through the optical fiber 90*f* to the light-emitting diode 90*d*, which is abbreviated as "LED" in FIG. 6. Similarly, the light-receiving sensor head 90*c* is connected through the optical fiber 90*g* to the photo-detecting diode 90*e*. The light-emitting sensor head 90*b* is spaced from the light-receiving sensor head 90*c*, and are accommodated in the sensor case 90*h*. An optical beam 90*j* is radiated between the light-emitting sensor head 90*b* and the light-receiving sensor head 90*c*, and is of the order of 5 millimeters in diameter.

The gap between the light-emitting sensor head 90*b* and the light-receiving sensor head 90*c* is open to the space under the keyboard 3 through a slit formed in the sensor case 90*h*. The light-emitting diode 90*d* keeps the amount of radiated light constant. The shutter plate 90*a* is moved into and out of the slit, and intersects the optical beam 90*j*. The shutter plate 90*a* varies the amount of light at the light-receiving sensor head 90*c* and, accordingly, the photo-detecting diode 90*c*, and the controller 100 estimates the current key position on the basis of the amount of light. Assuming now that the player depresses the black/white key 3*a*/3*b* from the rest position to the end position, the shutter plate 90*a* reaches the optical beam 90*j* at point P1, and gradually interrupts the optical beam 90*j* depending upon the key positions K1, K2, K2A, K3 and K4. Accordingly, the amount of light is gradually reduced, and reaches the minimum at the end position. The photo-detecting diode 90*e* proportionally converts the amount of light to electric current, and produces a key position signal S3 from the electric current. Thus, the magnitude of the key position signal S3 is representative of the current key position.

In this instance, twelve light-emitting diodes 90*d* and eight photodetecting diodes 90*e* are selectively connected to the sensor heads 90*b*/90*c*, and form an optical switching matrix. In detail, the light-emitting sensor heads 90*b* are divided into twelve groups, and the twelve groups are respectively connected to the twelve light-emitting diodes 90*d*. Each of the twelve groups of light-emitting sensor heads 90*b* is connected through the eight optical fibers 90*f* to one eight light-emitting diodes 90*d*, respectively. On the other hand, the light-receiving sensor heads 90*c* are divided into eight groups, and the eight groups are respectively connected to the eight photo-detecting diodes 90*e*. Each of the of light-receiving sensor heads 90*c* is connected through twelve optical fibers 90*g* to one photo-detecting diode 90*e*. The twelve light-emitting, diodes 90*d* are sequentially energized, and each of the light-emitting diodes 90*d* concurrently illuminates the eight optical fibers 90*f*. The eight optical fibers 90*f* propagate the light to the eight light-emitting sensor heads 90*b*, respectively, and the eight light-emitting sensor heads 90*b* radiate the eight optical beams 90*j* to the associated light-receiving sensor heads 90*c*. The eight light-receiving sensor heads 90*c* transfers the incident light through the eight optical fibers 90*g* to the eight photo-detecting diodes 90*e*, and the eight photo-detecting diodes 90*e* concurrently converts the incident light to the eight key position signals S3. The light emitting diodes 90*d* are sequentially energized, and the eighty-eight black/white keys 3*a*/3*b* are periodically checked with the optical beams 90*j*.

Automatic Playing System

The automatic playing system 30 includes the key sensors 90, the controller 100 and key actuators 30*a*. A recording mode and a playback mode are selectively established in the automatic playing system 30. The modes of operation are instructed through the manipulating panel 110. The key actuator 30*a* may be implemented by a solenoid-operated actuator. The key actuators 30*a* are respectively associated with the black/white keys 3*a*/3*b*, and are mounted on the key bed 4*a* under the associated black/white keys 3*a*/3*b*, respectively. The key actuator 30*a* has a solenoid 30*b* and a plunger 30*c* projecting from and retracted into the solenoid 30*b*. When the controller 100 energizes the solenoid 30*b* with a driving signal S4, the plunger 30*c* projects from the solenoid 30*b*, and pushes the lower surface of the associated black/white key 3*a*/3*b*. The plunger 30*c* exerts the force corresponding to the final hammer velocity of the associated hammer 6 on the lower surface of the black/white key 3*a*/3*b*.

The player is assumed to instruct the controller 100 to record a piece of music through the manipulating panel 110. Each of the key sensors 90 monitors the key motion of the associated black/white key 3*a*/3*b*, and supplies the key position signals S3 to the controller 100. The key position signal S3 varies the magnitude depending upon the current key position. The controller 100 discriminates the depressed keys 3*a*/3*b* and the kind of the key motion, i.e., the ordinary key motion or the abrupt key motion, and exactly estimates the final hammer velocity. The controller 100 produces music data codes representative of the final hammer velocity and key-on times at which the hammers 6 strikes the associated sets of strings 7. The final hammer velocity is proportional to the downward key velocity, and is hereinbelow simply referred to as "velocity".

Similarly, the controller 100 determines release rates and key-off times at which the released keys 3*a*/3*b* bring the damper heads 6*c* into contact with the sets of strings 7, and produces music data codes representative of the times and the release rates. The release rate is indicative of the decay of the acoustic sound. The controller 100 stores the music data codes representative of the performance in a floppy disk 40, by way of example. Thus, each of the key motion is described with the music data codes, which contains pieces of music data information representative of the key number, the key-on time, the magnitude of the velocity, the key-off time and the release rate. The music data codes may be formatted in accordance with the MIDI (Musical Instrument Digital Interface) standards.

If the player instructs the controller 100 to reproduce the performance through the manipulating panel 110, the controller 100 reads out the music data codes from the floppy disk 40, and sequentially supplies the driving signal S4 to the key actuators 30*a*. The magnitude of the driving signal S4 is exactly adjusted to the value corresponding to the final hammer velocity. The key actuators 30*a* move the associated black/white keys 3*a*/3*b*, and the black/white keys 3*a*/3*b* actuate the associated key action mechanisms 5 without any fingering. The key action mechanisms 5 drive the associated hammers 6 for rotation, and each of the hammers 6 strikes the set of strings 7 at the final hammer velocity equal to that during the recording. As a result, the performance is exactly reproduced.

Controller

The controller 100 includes a central processing unit 100*a*, a read only memory 100*b*, a random access memory 100*c* and a shared bus 100*d*. The central processing unit 100*a*, the read only memory 100*b* and the random access memory 100*c* are respectively abbreviated as "CPU", "ROM" and "RAM" in FIG. 5. The central processing unit 100*a* may be implemented by a microprocessor. The read only memory 100*b* stores programmed instructions, and various tables are defined in the read only memory 100*b*. The music data codes are temporarily stored in the random access memory 100*c*, and calculating results are also temporarily stored in the random access memory 100*c*. The central processing unit 100*a*, the read only memory 100*b* and the random access memory 100*c* are connected to the shared bus 100*d*. The central processing unit 100*a* sequentially fetches the programmed instructions through the shared bus 100*d*, and executes them for given jobs. The central processing unit 100*a* has a CPU timer (not shown), and is selectively branched from a main routine program into subroutine programs at every timer interruption. The main routine program and the subroutine programs will be hereinlater described in detail. The central processing unit 100*a* writes pieces of data information into and reads out them from the random access memory device 100*c* through the shared bus 100*d*. The central processing unit 100*c* defines tables in the random access memory device during the execution of the programmed instructions.

The controller 100 further includes a driver circuit 100*e* for the actuator 20*b*, a tone generator 100*f*, an LED driver 100*g* and an analog-to-digital converter 100*h*. The LED driver 100*g* is abbreviated as "LED" driver in FIG. 5, and sequentially energizes the twelve light-emitting diodes 90*d* under the control of the central processing unit 100*a*. The analog-to-digital converter 100*h* is connected to the eight photo-detectors 90*c*, and converts the magnitude of each key position signal S3 to a binary value of a digital key position signal S6. As described hereinbefore, the eight photo-detecting diodes 90*e* concurrently converts the incident light to the eight key position signals S3. However, the analog-to-digital converter 100*h* has only four analog-to-digital converting units. The eight key position signals S3 are divided onto two groups, and the two groups are successively supplied to the four analog-to-digital converting units. Thus, the analog-to-digital converter 100*h* twice repeats the analog-to-digital conversion during the illumination on the eight optical fibers 90*f*. The twelve light-emitting diodes 90*d* and the eight photo-detecting diodes 90*e* produce ninety-six combinations, which is more than the eighty-eight black/white keys 3*a*/ 3*b*. Eighty-eight combinations are respectively assigned to the eighty-eight black/white keys 3*a*/ 3*b*. The central processing unit 100*a* sequentially gives timings for the illumination to the twelve light emitting diodes 90*d*, and determines the eight black/white keys 3*a*/3*b* checked with the optical beams 90*j*. For this reason, if one of the key position signals S3 changes the magnitude, the central processing unit 100*a* can specify the black/white key 3*a*/3*b*, and determines the key number assigned thereto.

The driver circuit 100*e*, the tone generator 100*f*, the LED driver 100*g* and the analog-to-digital converter 100*h* relate to the silent system 20. The driver circuit 100*e* and the tone generator 100*f* are connected to the shared bus 100*d*, and the LED driver 100*g* and the analog-to-digital converter 100*h* are connected through a suitable interface (not shown) to the shared bus 100*d*.

The angle detector 20*c* and the manipulating panel 110 are also connected to the shared bus 100*d* through the interface (not shown), and an player's instruction is given from the manipulating panel 110 in the form of an instruction signal S5. The central processing unit 100*a* periodically checks the interface to see whether or not the angle detector 20*c* or the manipulating panel 110 change the stopper position signal S1 or the instruction signal S5. If the stopper position signal S1 and/or the instruction signal S5 is changed, the central processing unit 100*a* fetches the stopper position signal Si and/or the instruction signal S5, and appropriately copes with the change.

For example, when the push button switch 110*a* is manipulated, the manipulating panel 110 supplies the instruction signal S5 representative of the change between the free position FP and the block position BP to the interface. The central processing unit 100*a* fetches the piece of instruction data through the shared bus 100*d*, and interprets the meaning of the instruction. Then, the central processing unit 100*a* instructs the driver circuit 100*c* to energize the actuator 20*b*, and monitors the rotation of the shaft 20*g* through the stopper position signal S1. The central processing unit 100*a* compares the current angular position represented by the stopper position signal S1 with the free/block position FP/BP to see whether or not the catcher stopper 20*a* reaches the free position/blocking position FP/BP. If the catcher stopper 20*a* is still on the way to the free/block position FP/ BP, the central processing unit 100*a* does not cancel the instruction. However, when the catcher stopper 20*a* reaches the free/block position FP/ BP, the central processing unit 100*a* cancels the instruction, and the driver circuit 100*e* removes the electric power from the actuator 20*b*. Then, the actuator 20*b* stops the rotation, and the catcher stopper 20*a* keeps the free/block position FP/BP.

The tone generator 100*f* is connected to the sound system 20*d*, and supplies the audio signal S2 thereto. The tone generator 100*f* has sixteen channels, and the sixteen channels are respectively associated with sixteen columns of a tone generation table. The tone generation table is defined in the random access memory 100*c*, and each of the columns of the tone generation table stores pieces of tone data information for generating a tone signal. The pieces of tone data information are independently accessed by the associated channels. This means that the tone generator 100*f* concurrently generates sixteen tone signals at the maximum. The tone generator 100*f* selectively assigns the music data codes representative of different electronic sounds to the sixteen channels, and the sixteen columns of the tone generation table are linked with the sixteen channels, respectively. The channel of the tone generator 100*f* accesses the pieces of tone data information in the associated column of the tone generation table, and gives an envelop to an oscillating signal so as to control the attack, the decay and the sustain of an electronic sound. The tone signal or signals are mixed into the audio signal S2, and the audio signal S2 is supplied to the sound system 20*d*. The tone generation table will be hereinlater described in detail.

While a player is fingering a piece of music on the keyboard 3, the key sensors 90 monitor the associated black/white keys 3*a*/3*b* to see whether the player depresses or releases them. The current key position of each black/white key 3*a*/3*b* is supplied to the analog-to-digital converter 100*h*, and the analog-to-digital converter 100*h* converts the key position signal S3 to the digital key position signal S6. The central processing unit 100*a* periodically fetches the digital key position signals S6 through the shared bus 100*d*, and compares the binary values with the previous binary values to see whether or not the black/white keys 3*a*/3*b* change the key positions. If any one of the black/white keys 3*a*/3*b* changes the key position, the central processing unit 100*a* accumulates the new key position in the random access memory 100*c*.

The central processing unit 100*a* determines the key number assigned to the depressed key 3*a*/3*b* and the kind of key motion, and exactly estimates the velocity. The central processing unit 100*a* supplies the pieces of music data information representative of the key number and the velocity at the key on time to the tone generator 100*f*, and the tone generator 100*f* produces the tone signal for the depressed key 3*a*/3*b*. The tone signal has the amplitude equivalent to the velocity, and the electronic sound has the loudness equal to that of the acoustic sound not produced through the vibrations of the set of strings 7. The audio signal S2 is produced from the tone signals, and is supplied to the sound system 20*d* for generating the electronic sounds.

The central processing unit 100*a* further determines the key number and the release rate for the released key 3*a*/3*b*, and transfers the pieces of music data information representative of the key number and the release rate to the tone generator 100*f* at the key-off time. Then, the tone generator 100*f* decays the tone signal, and the sound system 20*d* extinguishes the electronic sound at the release rate. Thus, the central processing unit 100*a* cooperates with the key sensors 90 and the tone generator 100*f* for electronically generating the tone signals.

The controller 100 further includes a floppy disk driver 100*j* and a driver circuit 100*k* for the key actuators 30*a*. The floppy disk driver 100*j*, the driver circuit 100*k*, the key sensors 90, the LED driver 100*g* and the analog-to-digital converter 100*h* are incorporated in the automatic playing system 30. The floppy disk driver 100*j* and the driver circuit 100*k* for the key actuators 30*a* are connected through the interface to the shared bus 100*d*, and the central processing unit 100*a* communicates with the floppy disk driver 100*j* and the driver circuit 100*k* through the shared bus 100*d*. The floppy disk driver 100*j* writes the music data codes into the floppy disk 40, and reads out the music data codes therefrom. The central processing unit 100*a* transfers the music data codes between the floppy disk driver 100*j* and the random access memory 100*c* through the shared bus 100*d*.

In the playback, the central processing unit 100*a* sequentially reads out the music data codes from the random access memory 100*c*, and determines the magnitude of the driving signals S4 to be supplied to the key actuators 30*a*. The magnitude of the driving signal S4 is varied with the velocity represented by the music data code. When a music data code requests the central processing unit 100*a* to move one of the black/white keys 3*a*/3*b* from the rest position toward the end position, the central processing unit 100*a* determines the key number assigned to the black/white key 3*a*/3*b* and the magnitude of the driving signal S4 on the basis of the music data code, and supplies a piece of control data information to the driver circuit 100*k* through the shared bus 100*d*. Then, the driver circuit 100*k* regulates the magnitude of the driving signal S4 to the target value, and supplies the driving signal S4 to the key actuator 30*a*. The key actuator 30*a* pushes the associated black/white key 3*a*/3*b* at the instructed force, and the associated key action mechanism 5 drives the hammer 6 at the target velocity. The hammer 6 strikes the set of strings 7 at the target intensity, and the set of strings generates the acoustic sound at the loudness equal to the loudness in the original performance.

Calibration of Key Position

Products of the acoustic upright piano have individuality. Each of the light-emitting diodes 90*d* radiates the light to the eight optical fibers 90*f*. It is impossible to evenly share the light between the eight optical fibers 90*f*. This means that a calibration is required. Threshold values at the detecting points K1, K2, K3, K4 and K2A are determined during the calibration. The thresholds at the detecting points K1, K2, K3, K4 and K2A are used for determining key state. The detecting point K2A is provided between the detecting points K2 and K3, and the release rate is determined on the basis of the threshold value at the detecting point K2A.

Figure 8:
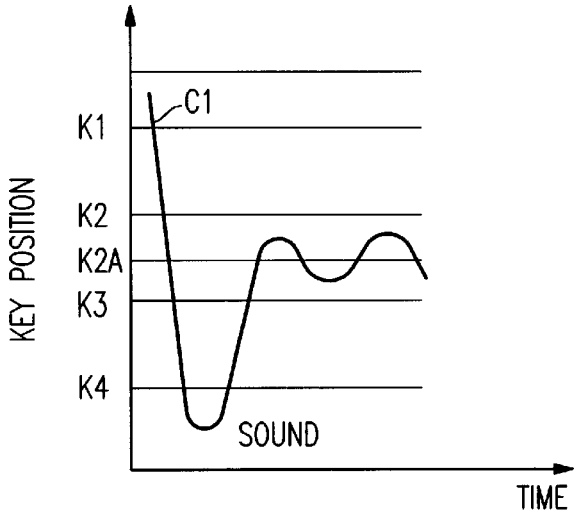
FIG. 8 is a graph showing a trajectory of a key.

FIG. 8 illustrates a trajectory C1 of one of the black/white keys 3*a*/3*b* in the ordinary key motion. The calibration for the black/white key 3*a*/3*b* proceeds as follows. When the controller 100 is powered on, the central processing unit 100*a* initializes the internal registers and the random access memory 100*c*, and calibrates the key sensors 90. The initialization step and the calibration step are inserted in a main routine program, and the main routine program will be hereinlater described in detail.

Figure 9:
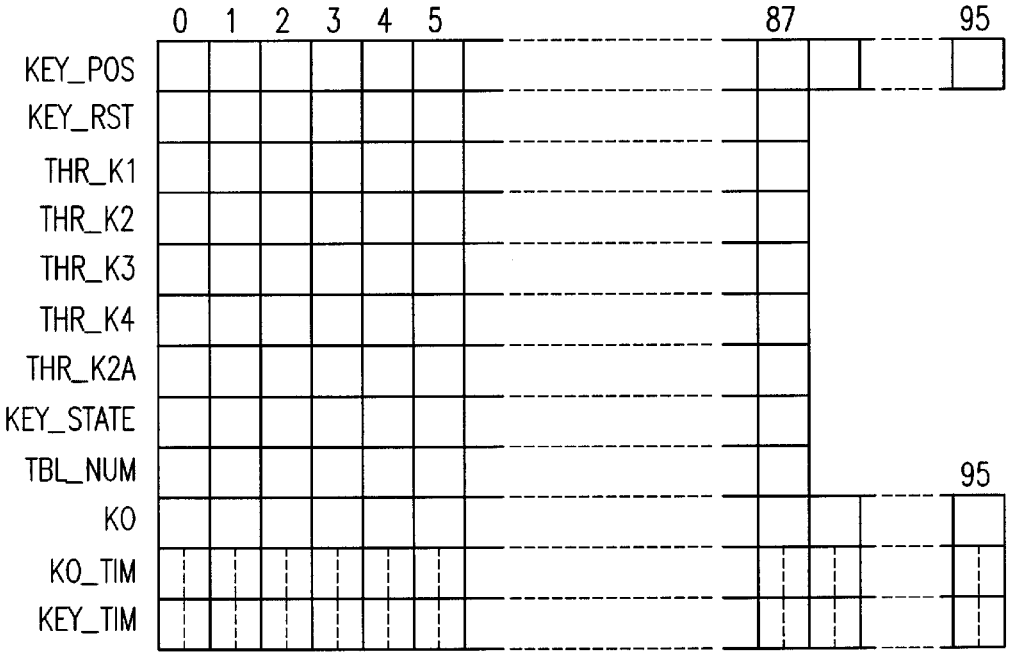
FIG. 9 is a view showing a key table defined in a random access memory for all the keys.

The central processing unit 100*a* instructs the LED driver 100*g* to sequentially energize the light-emitting diodes 90*d*, and receives the four digital key position signals twice at each photo-radiation. The central processing unit assigns a channel to every four digital key position signals, and channel "0" to channel "23" are assigned to the eighty-eight black/white keys 3*a*/3*b*. Although twenty-two channels are sufficient to the eighty-eight black/white keys 3*a*/3*b*, the twelve light-emitting diodes 90*d* and the eight photo-detecting diodes 90*e* produce the ninety-six combinations equivalent to the twenty-four channels. Accordingly, a key table has ninety-six columns labeled with "KEY_POS 0" to "KEY_POS 95" as shown in FIG. 9. However, only the eighty-eight columns "KEY_POS 0" to "KEY_POS 87" are assigned to the black/white keys 3*a*/3*b*.

Upon completion of the scanning for the digital key position signals S6, the central processing unit 100*a* obtains the maximum binary values X0, X1, X2 . . . and X87 of the digital key position signals S6 at the rest positions. The central processing unit 100*a* writes the maximum binary values X0 to X87 into the row of the key table "KEY_RST" .

Subsequently, the central processing unit 100*a* reads out sets of coefficients r1, r2, r3, r4 and r2A. The sets of coefficients r1, r2, r3, r4 and r2A have been given to the controller 100. The central processing unit 100*a* multiplies each of the maximum binary values by the coefficients ri (where i is 1, 2, 3, 4 and 2A), i.e., Xr×r1, Xr×r2, Xr×r3, Xr×r4 and Xr×r2A where the suffix r is 0, 1, 2, . . . and 87. Then, the central processing unit 100*a* obtains the thresholds K1, K2, K3, K4 and K2A for each of the black/white keys 3*a*/3*b*, and writes the thresholds K1, K2, K3, K4 and K2A into the rows of the key table "THR_K1", "THR_K2", "THR_K3", "THR_$_K$4" and "THR—K2A".

The manufacturer determines the coefficients ri through experiments. The manufacturer determines the detecting points K1–K4 and K2A to be appropriate for the discrimination of the key state, and the ratio of the binary value at each detecting point to the binary value at the rest position are calculated for all the black keys 3*a* and all the white keys 3*b*. The ratios are averaged, and the coefficients ri are obtained. A set of coefficients ri is used for the black keys 3*a*, and another set of coefficients ri is used for the white keys 3*b*.

The key table shown in FIG. 9 further has the following rows. The row labeled with "KEY_STATE" is assigned to a piece of control data information representative of the current key state, and the row labeled with "TBL_NUM" is assigned to another piece of control data information representative of the column number of the tone generation table in the tone generator 100*f*. The row labeled with "KEY_TIM" is assigned to a piece of control data information representative of the time at which the key position signals S3 are converted to the digital key position signals S6. The row labeled with "KO" and the row labeled with "KO_TIM" are assigned to pieces of control data information duplicated from the piece of control data information in the row "KEY_POS" and the piece of control data information in the row "KEY_TIM", respectively.

Figure 10A:
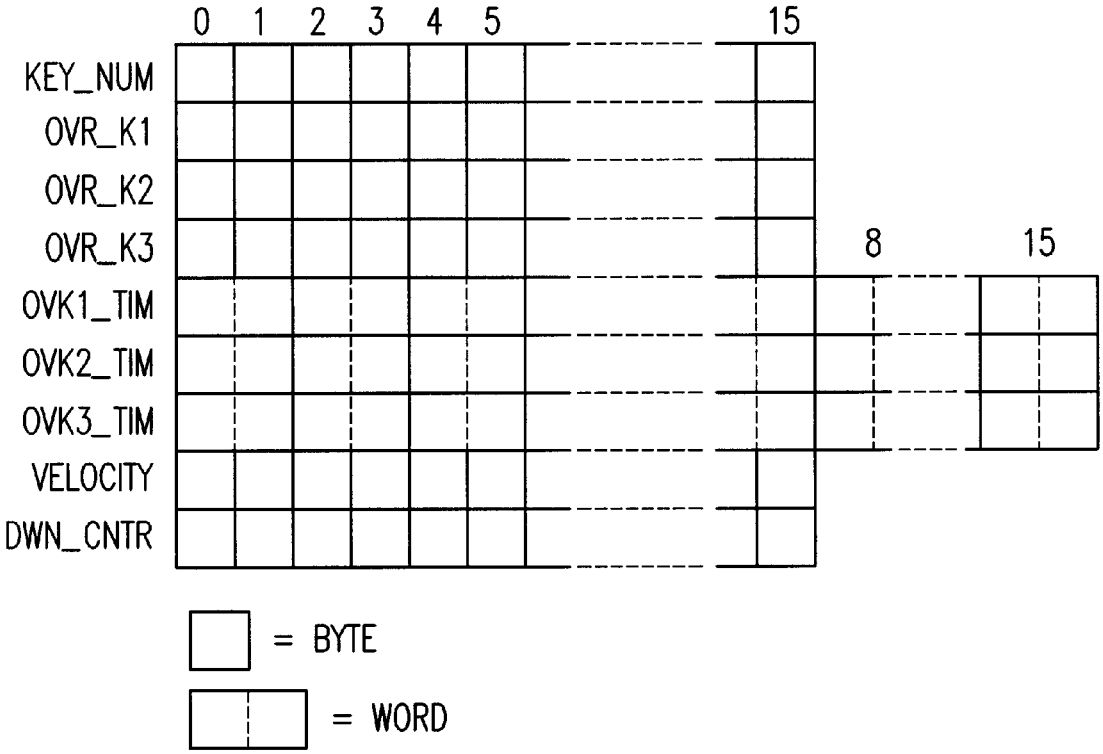
FIG. 10A is a view showing a tone generation table defined in the random access memory.

As described hereinbefore, the tone generation table is defined in the random access memory 100*c*. Though not shown in the drawings, sixteen overtime counters are defined in the random access memory device. FIG. 10A illustrates the tone generation table. A square box represents a byte, and a rectangular box with broken line is representative of a word, i.e., two bytes. The sixteen columns are labeled with "0", "1", "2". . . and "15", and are linked with the sixteen channels of the tone generator 100*f*. The overtime counters are respectively associated with the sixteen columns. The overtime counter is indicative of the continuation after entry into a certain kind of key state.

The first row is labeled with "KEY_NUM", and is assigned to the key number. If the key number "1" is written into the column "0", the associated channel accesses the pieces of tone data information stored in the column "0", and generates an electronic sound corresponding to the lowest-pitched acoustic sound.

The second row "OVR_K1", the third row "OVR_K2"and the fourth row "OVR_K3"store pieces of tone data information representative of detected key positions at which the digital key position signals S6 exceed the thresholds K1, K2 and K3. The fifth row "OVK1_TIM", the sixth row "OVK2_TIM" and the seventh row "OVK3_TIM" store pieces of tone data information representative of arrival times when the digital key position signals S6 downwardly pass the thresholds K1, K2 and K3. The central processing unit 100*a* periodically checks the interface to see whether the digital key position signals S6 exceed the thresholds K1 to K3. A time delay may be introduced between the detecting arrival time and the actual arrival time. The detected key position is stored together with the arrival time so as to make the tone data information reliable. Each piece of tone data information stored in the fifth row to the seventh row is two-byte long. In other words, each of the columns "0" to "15" partially expands in the fifth row to the seventh row as shown in FIG. 10.

The eighth row "VELOCITY" stores pieces of tone data information representative of the velocity or the intensity of an impact between the hammer 6 and the set of strings 7, and the last row "DWN_CNTR" stores pieces of tone data information representative of time periods until tone generation.

Figure 10B:
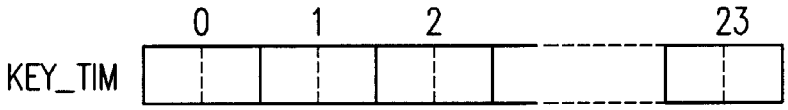
FIG. 10B is a view showing a time control table for channels across the key sensors.

FIG. 10B shows a time control table for the twenty-four channels created by the light-emitting diodes 90*d* and the photo-detecting diodes 90*e*. Two-bytes are assigned to each channel, and the central processing unit 100*a* stores a piece of time data information representative of the time when the four digital key position signals S6 are obtained through the channel.

The velocity is calculated as follows. A black/white key 3*a*/3*b* is assumed to move along the trajectory C1. The digital key position signal S6 exceeds the threshold Ki (i=1, 2 or 3) at a key position d1 and, thereafter, the threshold Kj (j=2, 3 or 4, j>i) at a key position d2. The arrival time at the key position d1 and the arrival time at the key position d2 are t1 and t2, respectively. The central processing unit 100*a* firstly calculates a normalized displacement Dn as follows.

$$Dn=(d1-d2)\times 2^8\div MAX\times 2^8$$

where MAX is the maximum binary value of the digital key position signal S6 at the rest position. The digital key position signal S6 is decreased from the rest position toward the end position. For this reason, the key position d2 is subtracted from the key position d1. The difference is indicative of the actual displacement of the black/white key 3*a*/3*b*, and the dispersion of the rest positions is normalized by dividing the actual displacement by the maximum binary value. Finally, the multiplication by $2^8$ makes the normalized displacement Dn equivalent to the two-byte data for the arrival time.

Subsequently, the central processing unit 100*a* calculates the key velocity Vk between the key positions d1 and d2.

$$Vk=Dn\div(t2-t1)\div 2^8$$

The key velocity is represented by a single byte because of the division by $2^8$.

Figure 11:
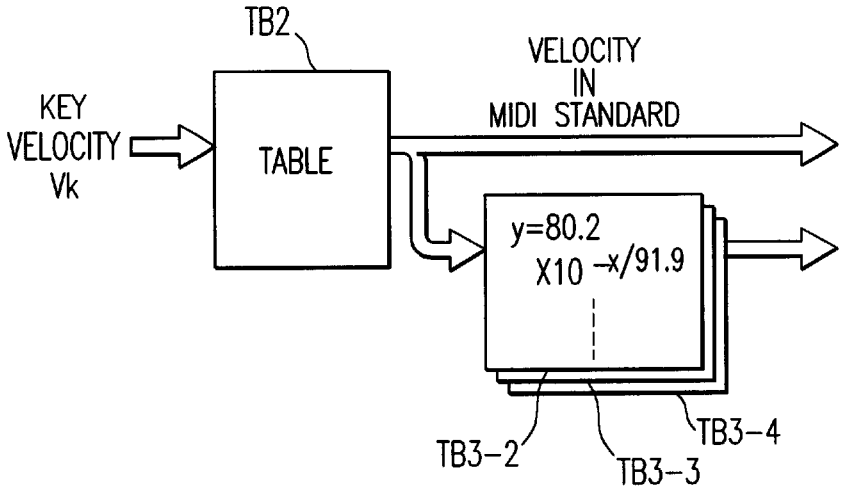
FIG. 11 is a block diagram showing the conversion from a key velocity to the velocity defined in the MIDI standards.

Subsequently, the central processing unit 100*a* estimates a hammer velocity at the impact as shown in FIG. 11. A conversion table TB2 is defined in the read only memory. The conversion table TB2 stores pieces of velocity data information representative of the velocity defined in the MIDI standards, and the relation between the key velocity Vk and the MIDI velocity are expressed by curves. The photo-detecting diodes 90*e* have non-linear photo-to current converting characteristics, and the binary key position signal S6 is effected by the non-linearity. In order to compensate the linearity of the key position data, the pieces of converting data information have been modified before storing the table TB2.

The central processing unit 100*a* supplies the key velocity Vk to the conversion table TB2, and the conversion table TB2 outputs the MIDI velocity. The MIDI velocity is written into the eighth row "VELOCITY" of the key table. The black/white key 3*a*/3*b* is moved along the trajectory C1, and the digital key position signal S6 sequentially exceeds the thresholds K1, K2, K3 and K4. When the digital key position signal S6 exceeds the next threshold K3 or K4, the central processing unit 100*a* calculates the key velocity Vk, and converts the key velocity Vk to the MIDI velocity. However, the central processing unit 100*a* does not rewrite the piece of tone data information representative of the velocity at all times. The central processing unit 100*a* rewrites the piece of tone data information only when the new MIDI velocity is larger than the MIDI velocity already stored in the key table.

Count-down tables TB3-2, TB3-3 and TB3-4 are further defined in the read only memory 100*b*. The count-down tables TB3-2, TB3-3 and TB3-4 are corresponding to the key position d2. If the digital key position signal S6 exceeds the threshold K2 at the key position d2, the count-down table TB3-2 is selected. However, when the digital key position signal S6 exceeds the threshold K3 or K4 at the key position d2, the count-down table TB3-3 or the count-down table TB3-4 is selected. The count-down tables TB3-2, TB3-3 and TB3-4 store pieces of time data information representative of time periods until the strikes of the strings 7 with the hammers 6. When the central processing unit 100*a* selects one of the count-down tables TB3-2, TB3-3 and TB3-4 corresponding to the threshold K2, K3 or K4, the count-down table assigns a series of pieces of time data information for the MIDI velocity to the black/white key 3*a*/3*b*, and the central processing unit 100*a* writes the first piece of time data information into the last row "DWN_CNTR" as the piece of tone data information. The piece of tone data information is periodically rewritten in accordance with the series of pieces of time data information. When the piece of tone data information in the last row "DWN-CNTR" is indicative of zero, the channel of the tone generator 100*f* receives the pieces of tone data information representative of the key number and the MIDI velocity from the key table, and starts to produce the tone signal. Thus, the row "DWN_CNTR" serves as counters for the tone generation. In the following description, the counters are labeled with "DWN_CNTR", and a rewriting operation of the piece of tone data information in the row "DWN_CNTR" is equivalent to a decrement of the counter.

Software

Figure 12:
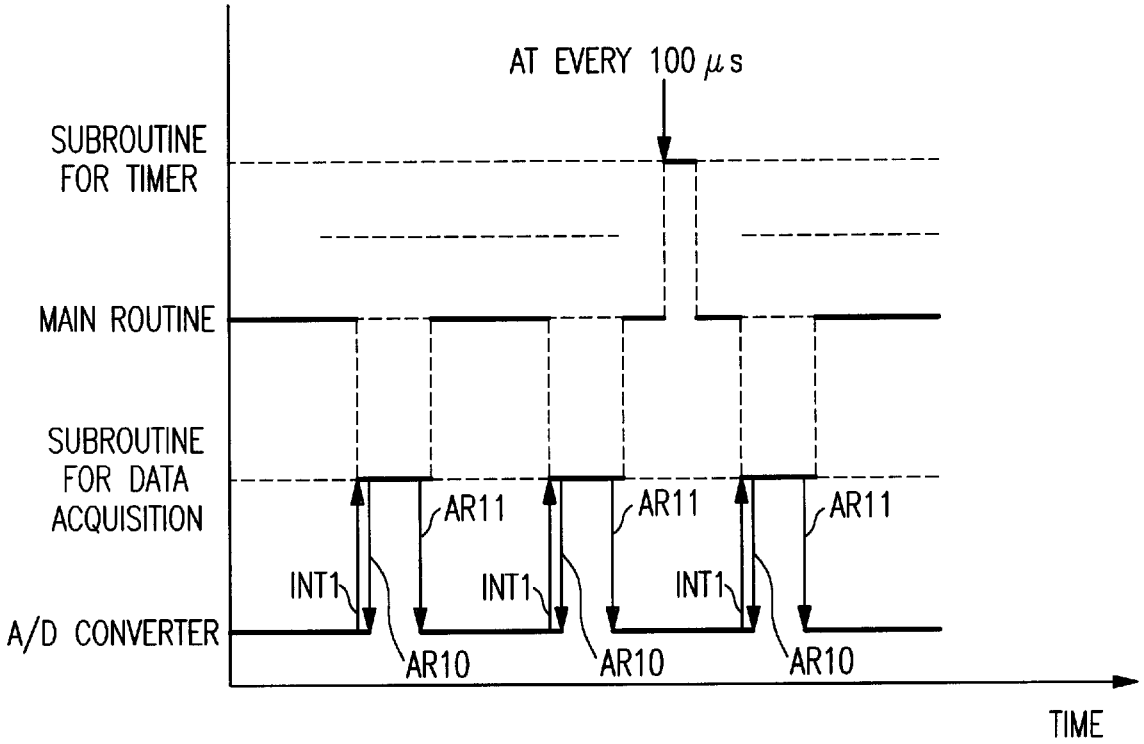
FIG. 12 is a timing chart showing the relation between a main routine and two interruption subroutines.

The central processing unit 100*a* fetches the programmed instructions from the read only memory 100*b*, and sequentially executes them. The programmed instructions form a main routine and two subroutines. FIG. 12 illustrates the relation between the main routine and two subroutines. The central processing unit 100*a* controls major part of the generation of tone signals through the main routine.

The central processing unit 100*a* is branched to the first subroutine at intervals of 100 microseconds. In the first interruption subroutine, the central processing unit 100*a* increments the CPU timer. Further, the central processing unit 100*a* rewrites the pieces of tone data information stored in the row "DWN_CNTR". This operation is equivalent to decrement of the counters "DWN_CNTR" as described hereinbefore.

On the other hand, the central processing unit 100*a* is branched to the second interruption subroutine at intervals of 40 milliseconds for a data acquisition. Dots on both sides of the control transfer to the first interruption subroutine are representative of the repetition of the control transfer between the main routine and the first interruption subroutine.

When the interruption INT1 takes place, the central processing unit 100*a* instructs the analog-to-digital converters 100*h* to maintain the current binary values as indicated by arrow AR10, and the analog-to-digital converters 100*h* repeatedly send the four digital key position signals S6 to the central processing unit 100*h*. Upon completion of the data acquisition, the central processing unit 100*a* instructs the analog-to-digital converters 100*h* to restart the analog-to-digital conversion as indicated by arrow AR11. The central processing unit 100*h* gives the priority to the first interruption for the timer increment, because the timer defines the fundamental timings in the tone generation.

Subroutine for Timer and Counters

Figure 13:
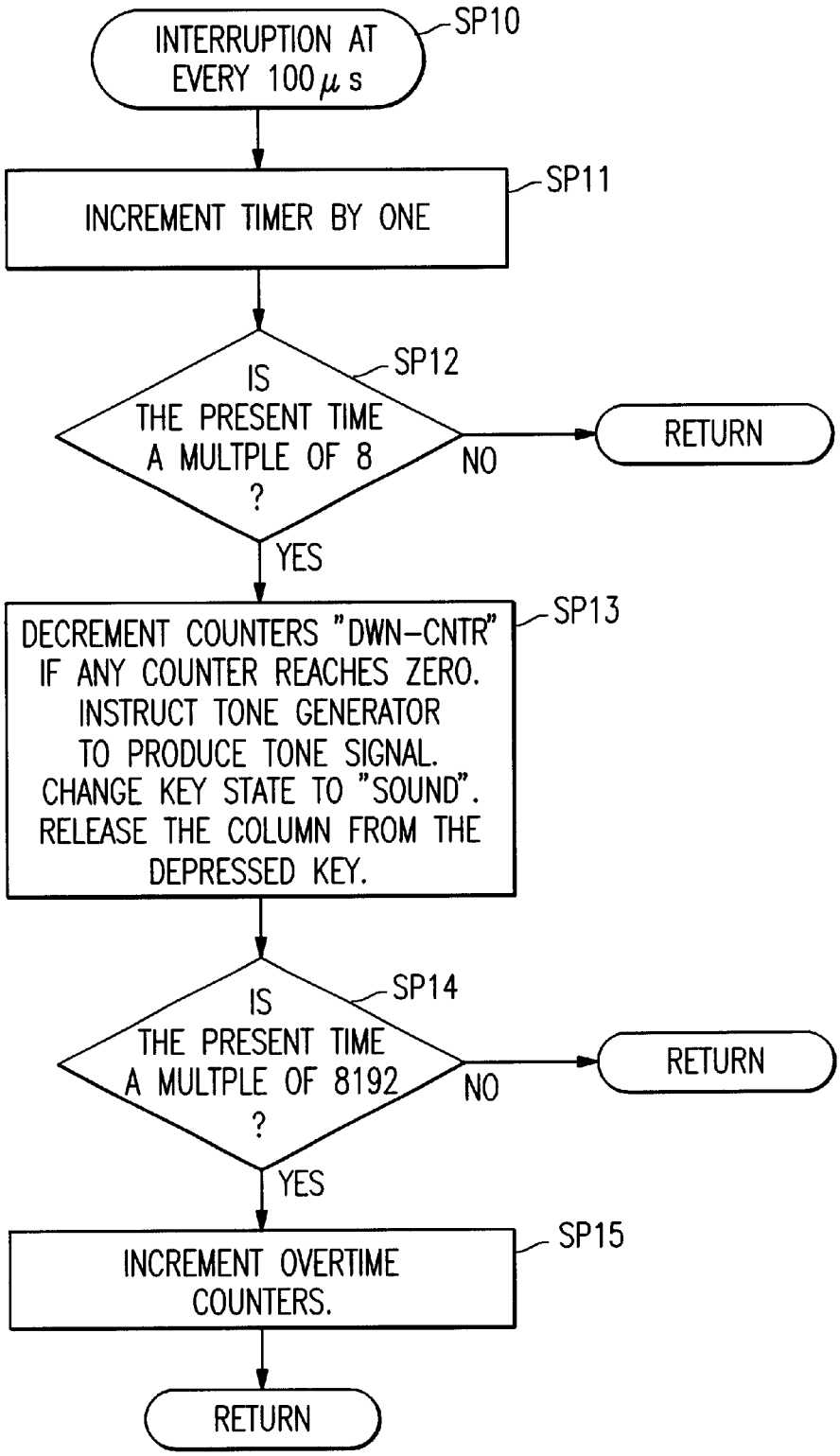
FIG. 13 is a flowchart showing a subroutine for a timer and counters.

FIG. 13 illustrates the subroutine program for the timer and the counters "DWN_CNTR". While the central processing unit 100*a* reiterates the main routine, the interruption takes place at every 100 microseconds as by step SP10. The central processing unit 100 is branched from the main routine to the first subroutine, and increments the CPU timer by one as by step SP11.

The central processing unit 100*a* has twenty-one registers En, RnH and RnL where n is zero to six as shown in FIG. 14. The internal register E6 is assigned to the timer, and the timer E6 is incremented by one at the step SP11. Other internal registers E5, R3H and R3L to R6L are assigned as follows.

The internal register E5 stores a time when the analog-to-digital conversion is carried out. The internal register R3H is assigned to the key state, and the current key position is stored in the internal register R3L. The internal register R4L stores the column number of the tone generation table, and the key number is stored in the internal register R5L. As described in conjunction with the key sensors 90, the eighty-eight black/white keys 3*a*/3*b* are selectively monitored through the twenty-four channels. The number of the channel is stored in the internal register R6L. The others are general purpose registers.

Turning back to FIG. 13, the central processing unit 100*a* increments the timer at every 100 microseconds, and the present time is maintained in the internal register E6. Upon completion of the increment, the central processing unit 100*a* proceeds to step SP12, and checks the timer E6 to see whether the present time is a multiple of eight or not. If the answer at step SP12 is negative, the central processing unit 100*a* returns to the main routine.

On the other hand, if the answer at step SP12 is given affirmative, the central processing unit 100*a* proceeds to step SP13. The central processing unit 100*a* executes the step SP13 at every 800 microseconds. The central processing unit 100*a* decrements the counters "DWN_CNTR", and checks the counters "DNW_CNTR" to see whether or not any one of the values stored therein reaches zero. If the answer is affirmative, the central processing unit 100*a* instructs the tone generator 100*f* to produce the tone signal, changes the key state to "SOUND", and releases the column of the tone generation table from the depressed key 3*a*/3*b*. This means that the column is assigned to a newly depressed key. In order to instruct the tone generator 100*f* to produce the tone signal, the central processing unit 100*a* supplies the pieces of tone data information representative of the key number and the MIDI velocity to the tone generator 100*f* together with an instruction indicative of a permission of tone generation. The tone generator 100*f* assigns the pieces of tone data information to a channel not occupied yet, and the channel produces the tone signal. This is equivalent to the following procedure. The central processing unit 100*a* changes the piece of control data information in the row "KEY_STATE" of the key table to "SOUND" representing that the channel is producing the tone signal, and cancels the piece of control data information indicative of the column number of the tone generation table. Then, the column of the tone generation table is released. On the other hand, if all the counters "DWN_CNTR" have not reached zero, yet, the central processing unit 100*a* proceeds to step SP14.

The central processing unit 100*a* checks the internal register E6 to see whether or not the present time is a multiple of 8192 at the step SP14. If the answer is given negative, the central processing unit 100*a* returns to the main routine. On the other hand, if the answer is given affirmative, the central processing unit 100*a* proceeds to step SP15. Thus, the step SP15 is executed at every 819.2 milliseconds.

In the step SP15, the central processing unit 100*a* increments the overtime counters associated with the sixteen columns of the tone generation table, respectively.

The overtime counter is indicative of the time period after entry into a kind of key state. The central processing unit 100*a* returns to the main routine.

Subroutine for Data Acquisition

Figure 15:
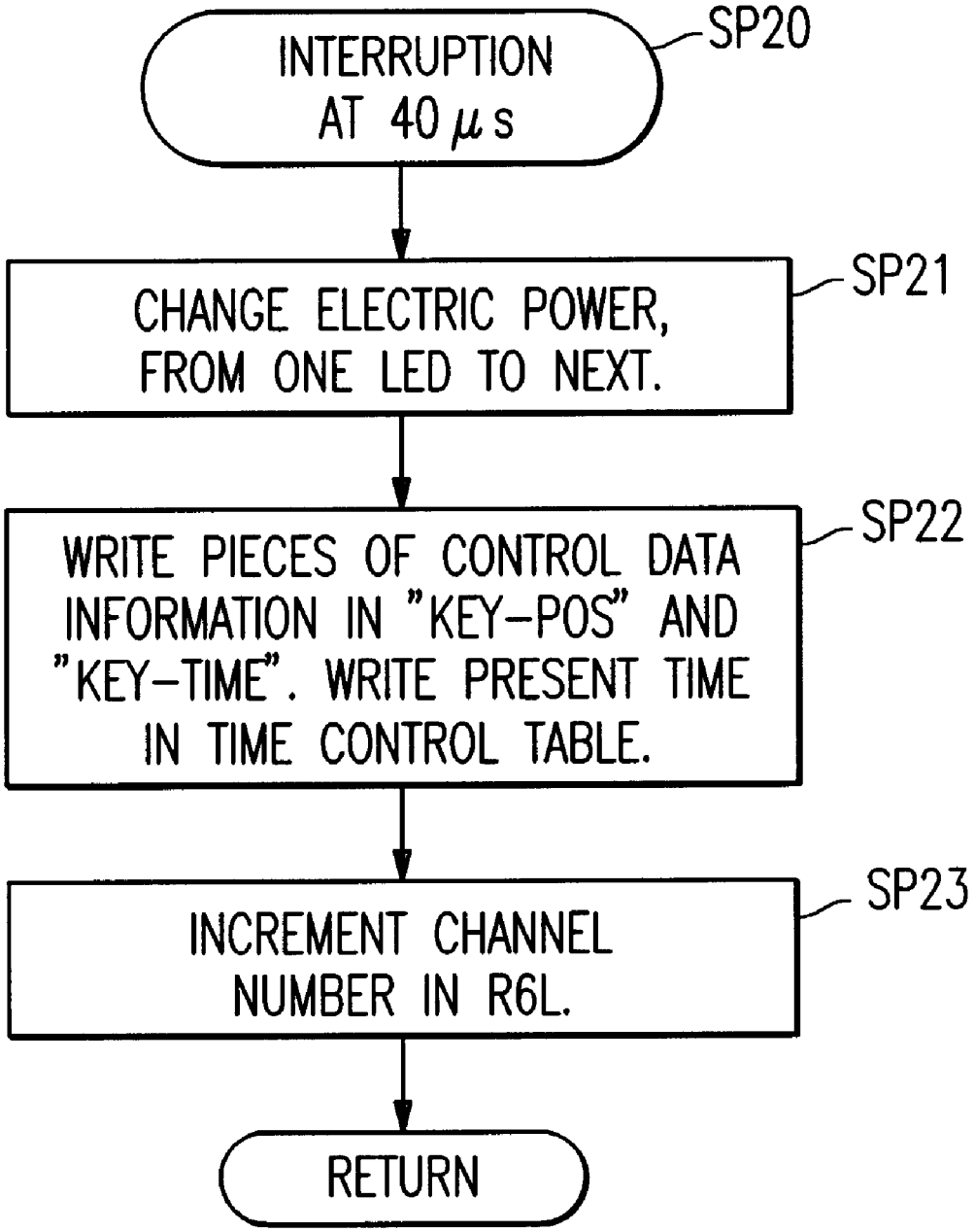
FIG. 15 is a flowchart showing a subroutine for data acquisition.

FIG. 15 illustrates the subroutine for the data acquisition. The analog-to-digital converters 100*h* are synchronous with the central processing unit 100*a*. Upon completion of the analog-to-digital conversion for the four digital key position signals S6, the interruption takes place at every 40 milliseconds. Then, the central processing unit 100*a* is branched to the subroutine as by step SP20. The central processing unit 100*a* instructs the LED driver 100*g* to remove the electric power from one of the light-emitting diodes 90*d* already energized, and further instructs the LED driver 100*g* to energize the next light-emitting diode 90*d* as by step SP21.

The central processing unit 100*a* proceeds to step SP22, and transfers the binary values of the digital key position signals S6 and the present time from the interface and the timer E6 to the key table. The binary values are written into the row "KEY_POS" under the key numbers assigned to the four black/white keys 3*a*/3*b*, and the present time is written into the row "KEY_TIM" also under the key numbers. Further, the central processing unit 100*a* transfers the present time to the time control table (see FIG. 10B), and writes the present time in the memory location assigned to the channel. Thus, the central processing unit 100*a* stores the time when the analog-to-digital converter 100*h* produces the four digital key position signals S6 in the time control table.

Finally, the central processing unit 100*a* increments the channel number stored in the internal register R6L as by step SP23. Then, the analog-to-digital converter 100*h* restarts the analog-to-digital conversion. Thus, the central processing unit 100*a* intermittently activates the analog-to-digital converter 100*h* as indicated by arrows AR10 and AR11 in FIG. 12, and rewrites the pieces of control data information in the key table. After step SP23, the central processing unit 100*a* returns to the main routine.

Main Routine

The central processing unit 100*a* determines the key state of the eighty-eight black/ white keys 3*a*/3*b* through the main routine. Description is firstly made on the key state with reference to FIG. 16. A black/white key 3*a*/3*b* is assumed to move between the rest position and the end position along a trajectory C2. The black/white key 3*a*/3*b* starts the motion at time t1, and the diaital key position signal S6 exceeds the thresholds K1, K2, K3 and K4 at times t2, t3, t4 and t5, respectively. The black/white key 3*a*/3*b* reaches the end position at time t6. In the following description, the positions at which the digital key position signal S6 exceeds the thresholds K1, K2, K3 and K4 are also labeled with "K1", "K2", "K3" and "K4", respectively.

While the black/white key 3*a*/3*b* is moving from the rest position to the position K1, the key state is "UPPER". When the black/white key 3*a*/3*b* passes the position K1, the key state is changed to "TOUCH-A". The black/white key 3*a*/3*b* successively enters the key state "COUNT-DOWN-0" at the position K2, the key state "COUNT-DOWN-1" at the position K3 and the key state "COUNT-DOWN-2" at the position K4. When the tone generator 100*f* generates the tone signal for an electronic sound, the key state is changed to "SOUND".

The black/white key 3*a*/3*b* is released at time t7, and passes the position K4 at time t8, the position K3 at time t9 and the position K2 at time t11. The black/white key 3*a*/3*b* stays the key state "SOUND" until the position K2, and changes the key state to "HOLD" at the position K2 due to the key-off.

The black/white key 3*a*/3*b* changes the direction of motion between the position K2 and the position K1, and passes the position K2 at time t11, the position K3 at time t12 and the position K4 at time t13. The black/white key 3*a*/3*b* changes the direction of key motion between the position K4 and the end position at time t14, and passes the position K4 at time t15, the position K3 at time t16 and the position K2 at time t17. The black/white key 3*a*/3*b* changes the direction of the key motion between the position K2 and the position K1, and passes the position K2 at time t18 and the position K3 at time t19. The black/white key 3*a*/3*b* changes the direction of the key motion between the position K3 and the position K4, again, and passes the position K3 at time t2O, the position K2 at time t21 and the position K1 at time t22. The black/white key 3*a*/3*b* finally returns to the rest position at time t23.

Figure 17:
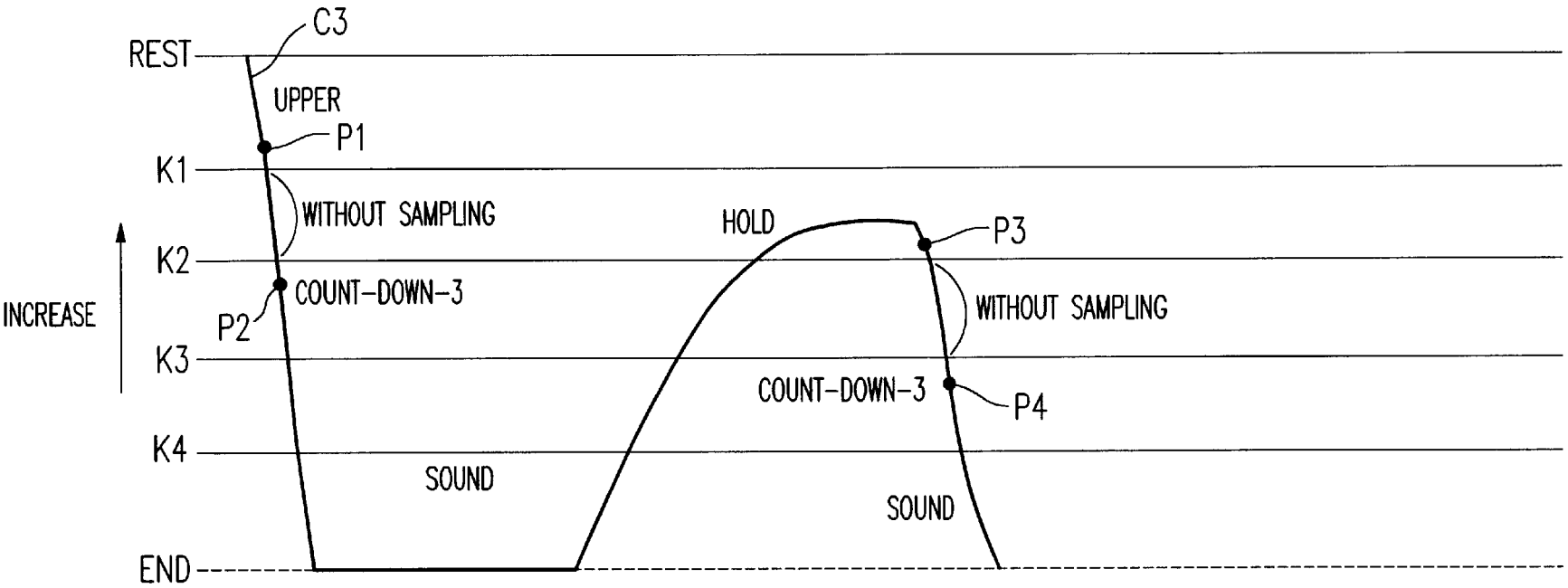
FIG. 17 is a graph showing another kind of key state given to an extremely high-speed key motion.

The key state is changed from "HOLD" to "TOUCH-B" at time t11. However, if the black/white key 3*a*/3*b* keeps the key state "TOUCH-B" for a predetermined time, the key state is changed to "TIME-OVER" (see the trajectory between time t18 and time t19). If the black/white key 3*a*/3*b* moves at an extremely high speed, the digital key position signal S6 exceeds more than one threshold, and the key state is changed to "COUNT-DOWN-3" in a single sampling interval. FIG. 17 illustrates the key state "COUNT-DOWN-3". A black/white key 3*a*/3*b* moves along a trajectory C3. The key velocity between the position P1 and the position P2 is so large that the black/white key 3*a*/3*b* passes the positions K1 and K2 within a single sampling interval. This means that the central processing unit 100*a* does not check the analog-to-digital converter 100*h* to see whether or not the digital key position signal S6 changes the binary value between the position P1 and the position P2. The central processing unit 100*a* notices that the black/white keys 3*a*/3*b* passes the two positions K1 and K2 between the previous data acquisition and the current data acquisition. The key motion between position P3 and the next position P4 also results in the key state "COUNT-DOWN-3".

Thus, the key state expresses different key motions on the trajectory C2/C3, and the central processing unit 100*a* determines the key state on the basis of the previous key state and the lapse of time therefrom.

Figure 18:
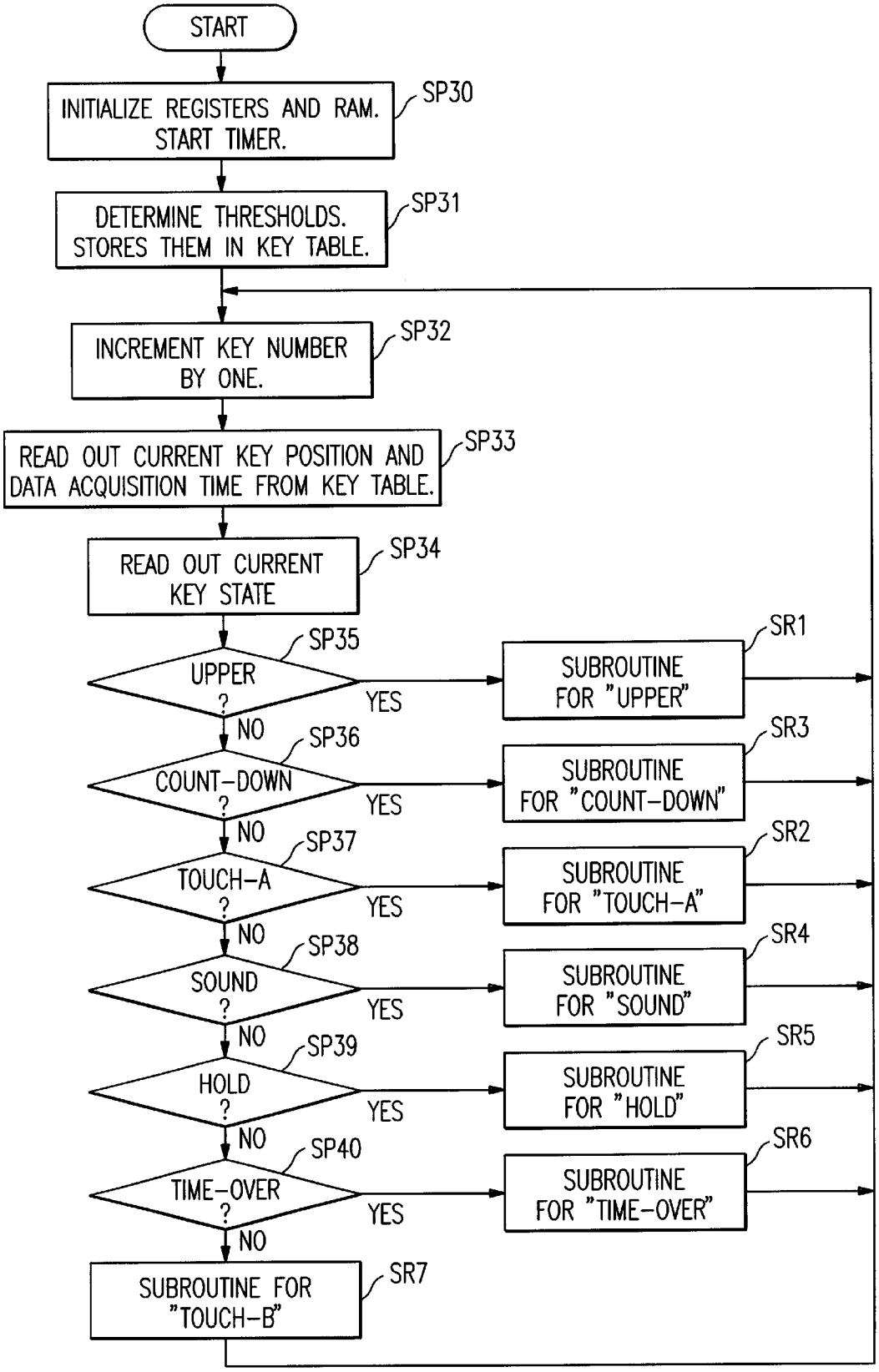
FIG. 18 is a flowchart showing a main routine.
Figure 19:
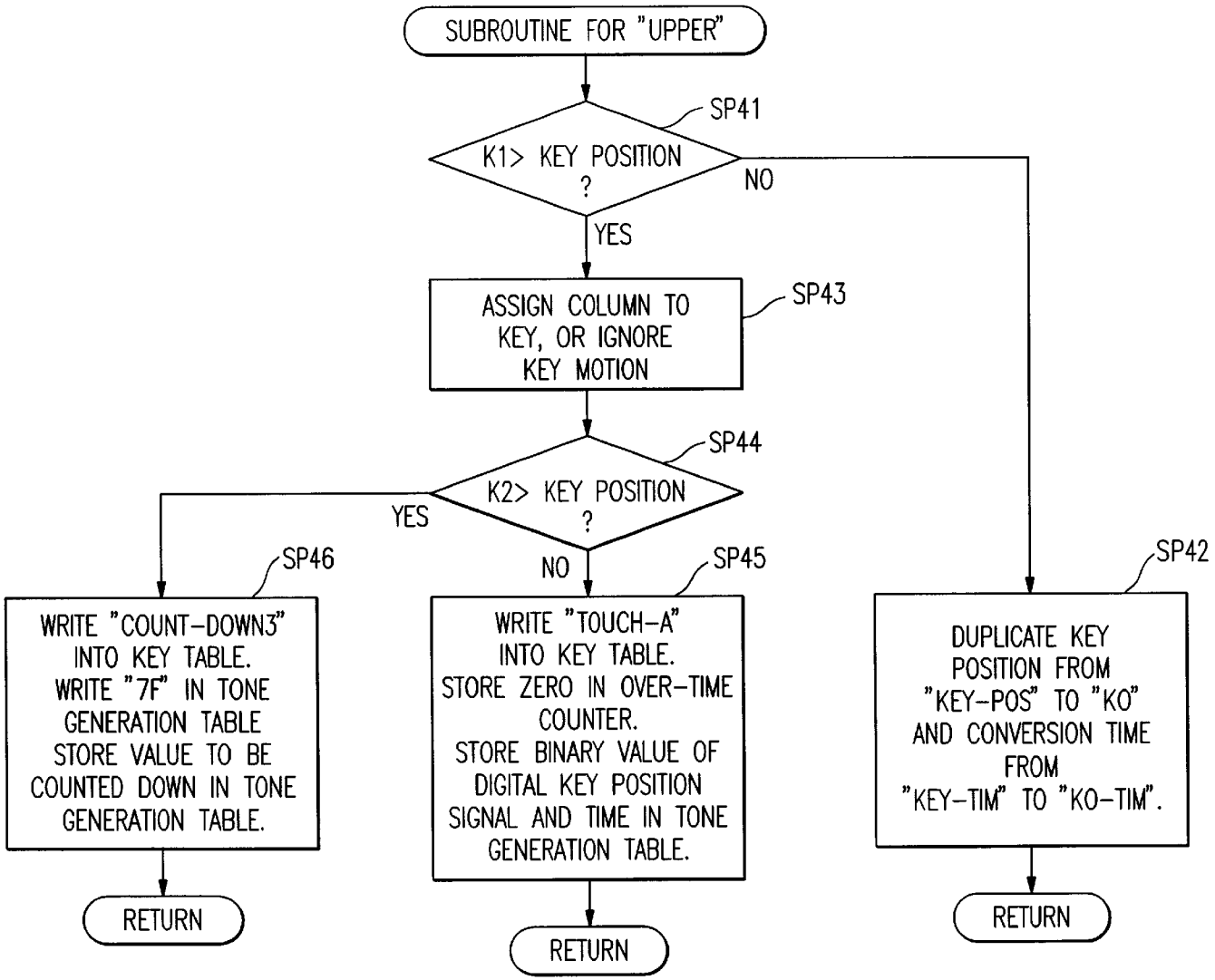
FIG. 19 is a flowchart showing a subroutine for "UPPER"
Figure 20:
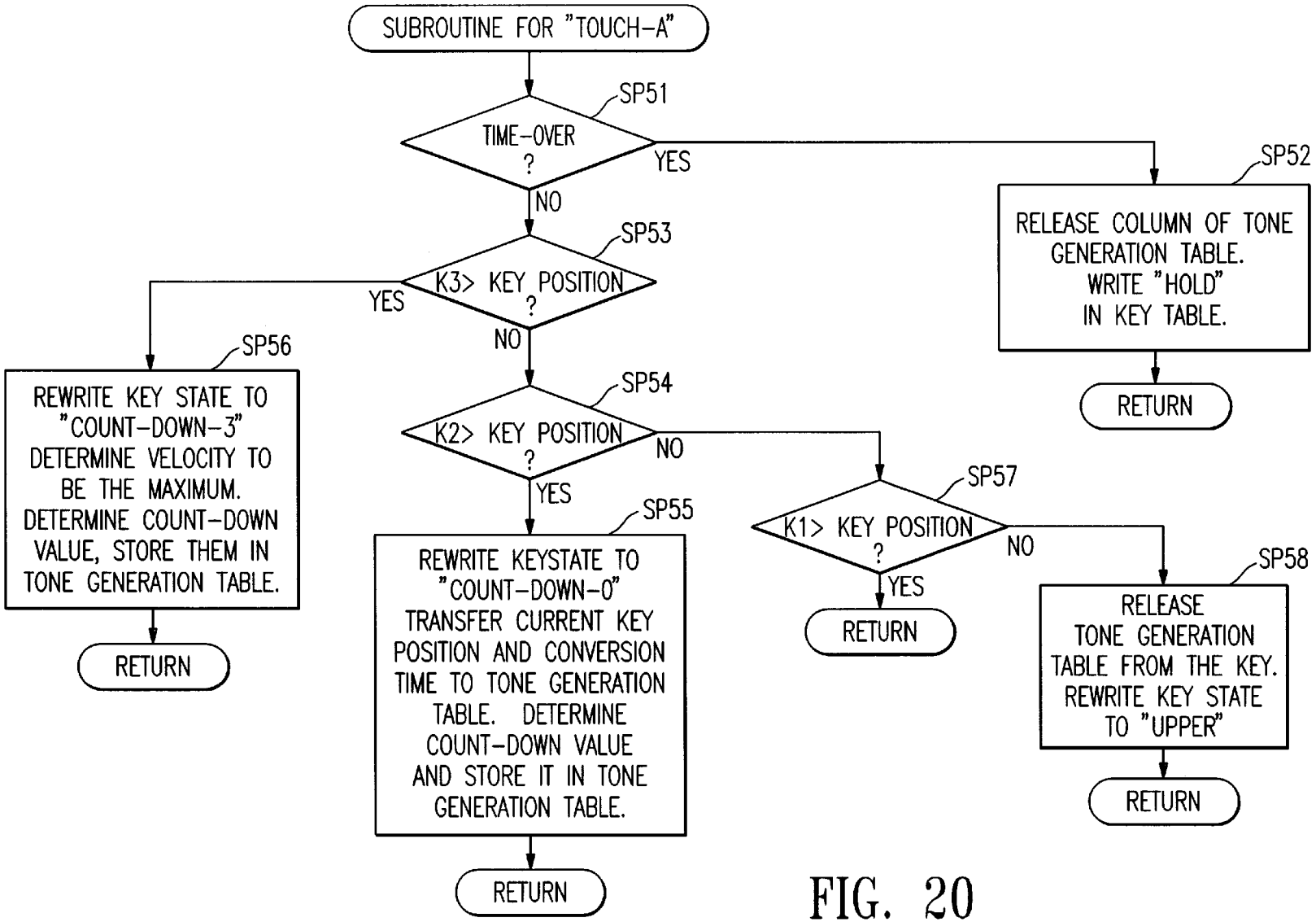
FIG. 20 is a flowchart showing a subroutine for "TOUCH-A"

FIG. 18 illustrates the main routine. When the controller 100 is powered, the central processing unit starts the main routine. The central processing unit 100*a* initializes the registers and the random access memory 100*c* and starts the timer as by step SP30.

The central processing unit 100*a* proceeds to step SP31. The central processing unit 100*a* instructs the driver circuit 100*k* to sequentially move the black/white keys 3*a*/3*b*, and calculates the thresholds K1, K2, K3, K4 and K2A for each of the black/white keys 3*a*/3*b*. The thresholds K1, K2, K3, K4 and K2A are written into the key table as described hereinbefore.

Subsequently, the central processing unit 100*a* increments the key number stored in the register R5L by one as by step SP32. If the internal register R5L stores the key number 87, the central processing unit 100*a* changes the key number to zero. The internal register R5L indicates the black/white key 3*a*/3*b* for which the pieces of information are processed. For this reason, the key number stored therein is looped between zero and eighty-seven. The following steps in the main routine and associated subroutines are executed for the black/white key 3*a*/3*b*, the key number of which is stored in the internal register R5L. For this reason, the term "black/white key 3*a*/3*b*" means the black/white key 3*a*/3*b* indicated by the key number stored in the internal register R5L unless the term is accompanied with other definition.

Subsequently, the central processing unit 100*a* accesses the key table, and reads out the pieces of control data information representative of the newest binary value of the digital key position signal S6 and the acquisition time from the row KEY_POS and KEY_TIM for the black/white key 3a/3b indicated by the internal register RSL as by step SP33. The pieces of control data information in the rows KEY_POS and KEY_TIM are periodically renewed at step SP22 (see FIG. 15). The central processing unit 100a writes the pieces of control data information read out from the key table into the internal register R3L and E5, respectively.

Subsequently, the central processing unit 100a reads out the piece of control data information respresentative of the current key state from the row KEY_STATE of the key table for the black/white key 3a/3b indicate d by the internal register R5L as by step SP34, and stores the current key state in the internal register R3H. The central processing unit 100a sequentially examines the current key state, and is selectively branched into subroutine programs shown in FIGS. 19 to 26.

The central processing unit 100a firstly checks the current key state to see whether or not the black/white key 3a/3b is in the state "UPPER" as by step SP35. If the answer at step SP35 is given affirmative, the central processing unit 100a enters the subroutine for "UPPER" shown in FIG. 19.

In the subroutine for "UPPER", the central processing unit 100a firstly checks the internal register R3L to see whether or not the current key position is under the detecting point K1 as by step SP41. If the black/white key 3a/3b is in the rest position or just starts the motion, the answer at step SP41 is given negative, and the central processing unit 100a proceeds to step SP42. Then, the central processing unit 100a duplicates the piece of control data information representative of the binary value of the digital key position signal S6 from the memory location of the row "KEY_POS" assigned to the black/white key 3a/3b to the corresponding memory location of the row "KO" and the piece of control data information representative of the conversion time from the memory location of the row "KEY_TIM" to the corresponding memory location of the row "KO_TIM". Upon completion of the duplication, the central processing unit 100a returns to the step SP32. Thus, the pieces of control data information in the rows "KO" and "KO_TIM" are repeatedly renewed until the black/white key 3a/3b passes the detecting point K1.

On the other hand, if the black/white key 3a/3b has been already passed the detecting point K1, the answer at step SP41 is given affirmative, and the central processing unit 100a recognizes that the player depresses the black/white key 3a/3b. Then, the central processing unit 100a proceeds to step SP43. The central processing unit 100a firstly searches the tone generation table to see whether or not there is a column not assigned to the other black/white keys 3a/3b. When there is not any non-assigned column, the central processing unit 100a decides to ignore the key motion, because the sixteen channels have been already busy. Then, the central processing unit 100a returns to the step SP32 of the main routine. On the other hand, if there is a non-assigned column, the central processing unit 100a writes the piece of tone data information representative of the key number of the black/white key 3a/3b into the memory location at the crossing point between the row "KEY_NUM" and the non-assigned column.

Subsequently, the central processing unit 100a checks the internal register R3L to see whether or not the black/white key 3a/3b has already downwardly passed the next detecting point K2 as by step SP44. If the black/white key 3a/3b is on the way from the detecting point K1 to the next detecting point K2, the answer at step SP44 is given negative, and the central processing unit 100a proceeds to step SP45. As described hereinbefore, the black/white key 3a/3b on the way to the detecting point K2 is in the key state "TOUCH-A" (see FIG. 16). The central processing unit 100a writes the piece of control data information representative of the key state "TOUCH-A" into the memory location in the row "KEY STATE" assigned to the black/white key 3a/3b (see FIG. 9). The central processing unit 100a writes zero into the memory location of the time control table assigned to the black/white key 3a/3b, and transfers the binary value of the digital key position signal S6 and the conversion time from the internal registers R3L and E5 to the tone generation table. The binary value and the conversion time are respectively stored in the memory location in the row OVR_K1 and the memory location in the row OVK1_TIM both assigned to the channel. Thus, the central processing unit 100a stores the position and the time at which the black/white key 3a/3b exceeds the threshold K1 in the tone generation table. The central processing unit 100a returns to step SP32 in the main routine.

If the black/white key 3a/3b has passed the detecting point K2, the answer at step SP44 is given affirmative, and the central processing unit 100a proceeds to step SP46. The black/white key 3a/3b is moving at high speed (see the trajectory between points P1 and P2 in FIG. 17), and passes the two detecting points K1 and K2 during the single sampling period. The central processing unit 100a rewrites the piece of control data information in the memory location in the row KEY_STATE assigned to the black/white key 3a/3b from the key state "UPPER" to the key state "COUNT-DOWN-3". The central processing unit 100a assumes the black/white key 3a/3b to move at the maximum speed, and writes the piece of tone data information representative of the maximum key velocity "7F" in the memory location in the row "VELOCITY" assigned to the channel. The central processing unit 100a determines the time to be expired until the tone generation on the basis of the maximum key velocity, and stores the number to be counted down in the memory location in the row "DWN_CNTR" assigned to the channel. The value to be counted down is equivalent to the time to be expired until the tone generation. Although the time is determined by using one of the count-down tables TB-3-2, TB3-3, TB3-4 . . . (see FIG. 11), the maximum value "7F" is given to the velocity regardless of the pieces of converting data information stored in the conversion table TB2. The central processing unit 100a returns to the step SP32 in the main routine.

Turning back to FIG. 18, if the key state has been already changed to "TOUCH-A" (see SP45 in FIG. 19), the answer at step SP35 and the answer at step SP36 are given negative, but the answer at step SP37 is given affirmative. Then, the central processing unit 100a enters the subroutine SR2 for "TOUCH-A" shown in FIG. 20.

The central processing unit 100a firstly checks the overtime counter to see whether or not the associated overtime counter has already exceeded the critical value indicative of the key state "TIME_OVER" as by step SP51. The overtime counter is periodically incremented at the step SP15 of the first interruption subroutine (see FIG. 13), and, accordingly, is to exceed the critical value in so far as it is not reset. When the black/white key 3a/3b keeps the key state "TOUCH-A" over the critical time period, the player shallowly depressed the black/white key 3a/3b, but he has not depressed the black/white key 3a/3b. In this situation, the central processing unit 100a releases the column of the tone generation table from the black/white key 3a/3b, because the channel is required for another depressed key. The central processing unit 100a changes the key state from "TOUCH-A" to "HOLD", and stores the piece of control data information representative of the key state "HOLD" in the memory location of the row "KEY_STATE" assigned to the black/white key 3*a*/3*b*. Of course, when the player depresses the black/white key 3*a*/3*b* from the key position between the detecting points K1 and K2 toward the end position, the central processing unit 100*a* restarts the data processing for the black/white key 3*a*/3*b* as will be described hereinlater. The central processing unit 100*a* returns to the step SP32 in the main routine.

On the other hand, if the black/white key 3*a* /3*b* is continuously moving, downwardly, the answer at step SP51 is given negative, and the central processing unit 100*a* checks the key table to see whether or not the black/white key 3*a*/3*b* has already downwardly passed the detecting point K3 as by step SP53.

If the answer at step SP53 is given negative, the central processing unit 100*a* further checks the current key position to see whether or not the black/white key 3*a*/3*b* has downwardly passed the detecting point K2 as by step SP54. If the black/white key 3*a*/3*b* is moving between the detecting points K2 and K3, the answer at step SP54 is given affirmative, and the central processing unit 100*a* proceeds to step SP55. The central processing unit 100*a* rewrites the piece of control data information stored in the memory location of the row KEY_STATE assigned to the black/white key 3*a*/3*b* from "TOUCH_A" to "COUNT-DOWN-0". The central processing unit 100*a* further transfers the current key position and the conversion time from the internal registers R3L and E5 to the memory location of the row OVR-K2 and the memory location of the row OVK2-TIM both assigned to the channel, and stores them as the pieces of tone data information. The key position and the conversion time at the detecting point K1 have been already stored in the tone generation table. Using the key position and the conversion time at the detecting point K1 and the key position and the conversion time at the detecting point K2, the central processing unit 100*a* calculates the key velocity Vk, and determines the velocity and the values to be counted down (see FIG. 11). The central processing unit 100*a* stores the piece of tone data information representative of the velocity and the piece of tone data information representative of the value to be counted down in the memory location of the row "VELOCITY" and the memory location of the row "DWN_CNTR" assigned to the channel. Upon completion of the jobs at step SP55, the central processing unit 100*a* returns to step SP32 in the main routine.

If the black/white key 3*a*/3*b* passes the detecting points K2 and K3 in the single sampling period (see the key motion between points P3 and P4 in FIG. 17), the answer at step SP53 is given affirmative, and the central processing unit 100*a* proceeds to step SP56. The central processing unit rewrites the piece of control data information representative of the key state from "TOUCH-A" to "COUNT-DOWN-3", and determines the velocity to be the maximum value "7F". The velocity is supplied to the count-down table TB3-2 . . . , and the value to be counted down is determined. The central processing unit 100*a* stores the piece of tone data information representative of the maximum velocity and the piece of tone data information representative of the value to be counted down in the memory location of the row "VELOCITY" assigned to the channel and the memory location of the row "DOWN-CNTR" assigned to the channel. The data processing at step SP56 is similar to that at step SP46.

When the black/white key 3*a*/3*b* did not pass the detecting point K2, the answer at step SP54 is given negative, and the central processing unit 100*a* compares the current key position with the threshold K1 to see whether or not the black/white key 3*a*/3*b* has downwardly passed the detecting point K1 as by step SP57. If the black/white key 3*a*/3*b* is staying between the detecting points K1 and K2, the key state is still "TOUCH-A", and the answer at step SP57 is given affirmative. Then, the central processing unit 100*a* returns to the step SP32 in the main routine.

However, if the black/white key 3*a*/3*b* returned from the key position between the detecting points K1 and K2 toward the rest position, the answer at step SP57 is given negative, and the central processing unit 100*a* proceeds to step SP58. The central processing unit 100*a* releases the column of the tone generation table from the black/white key 3*a*/3*b*, and any electronic sound is not generated. The channel released from the black/white key 3*a*/3*b* is available for the control of tone generation. The central processing unit 100*a* rewrites the key state from "TOUCH-A" to "UPPER", and returns to the step SP32 of the main routine.

Figure 21:
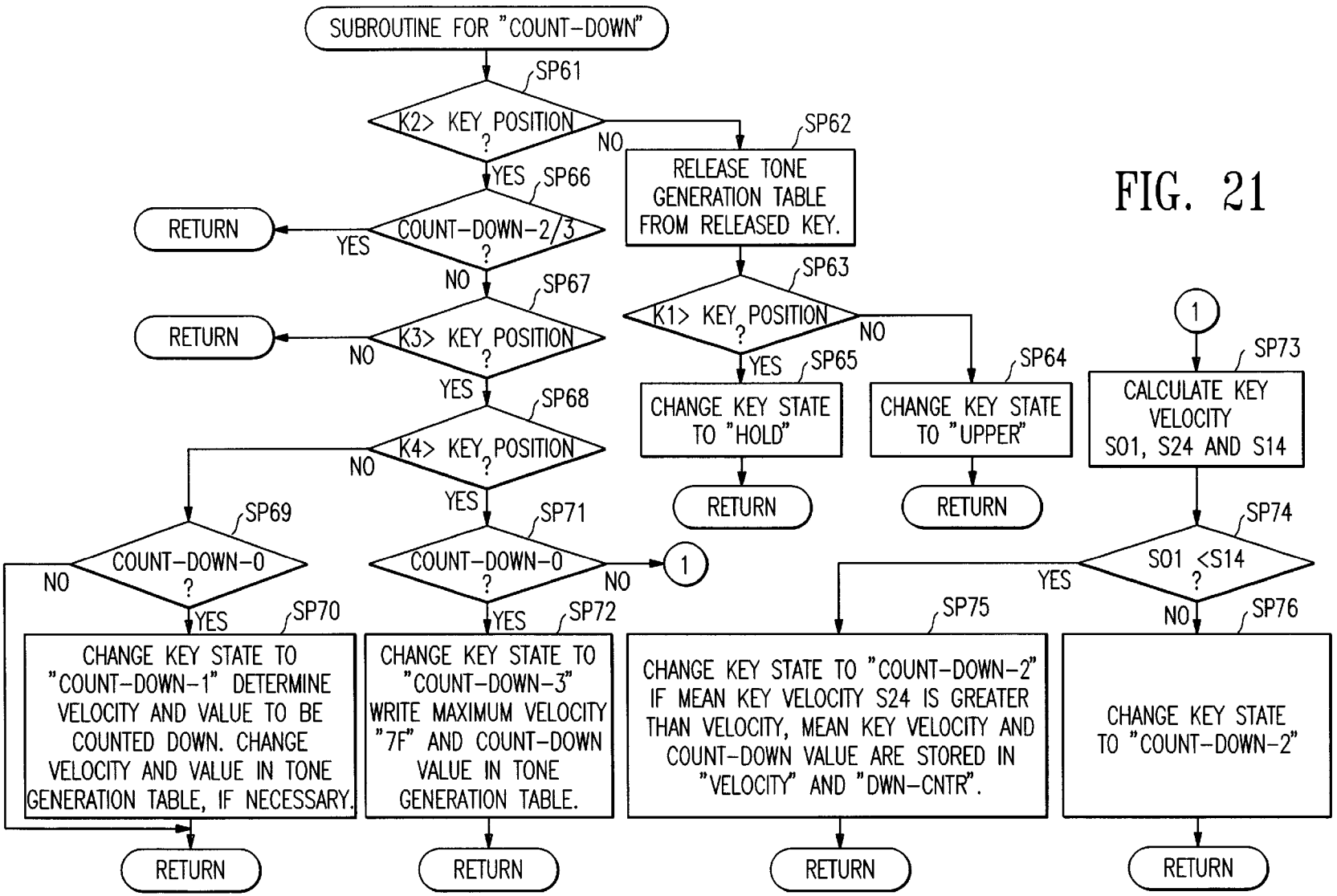
FIG. 21 is a flowchart showing a subroutine for "COUNT-DOWN"
Figure 22:
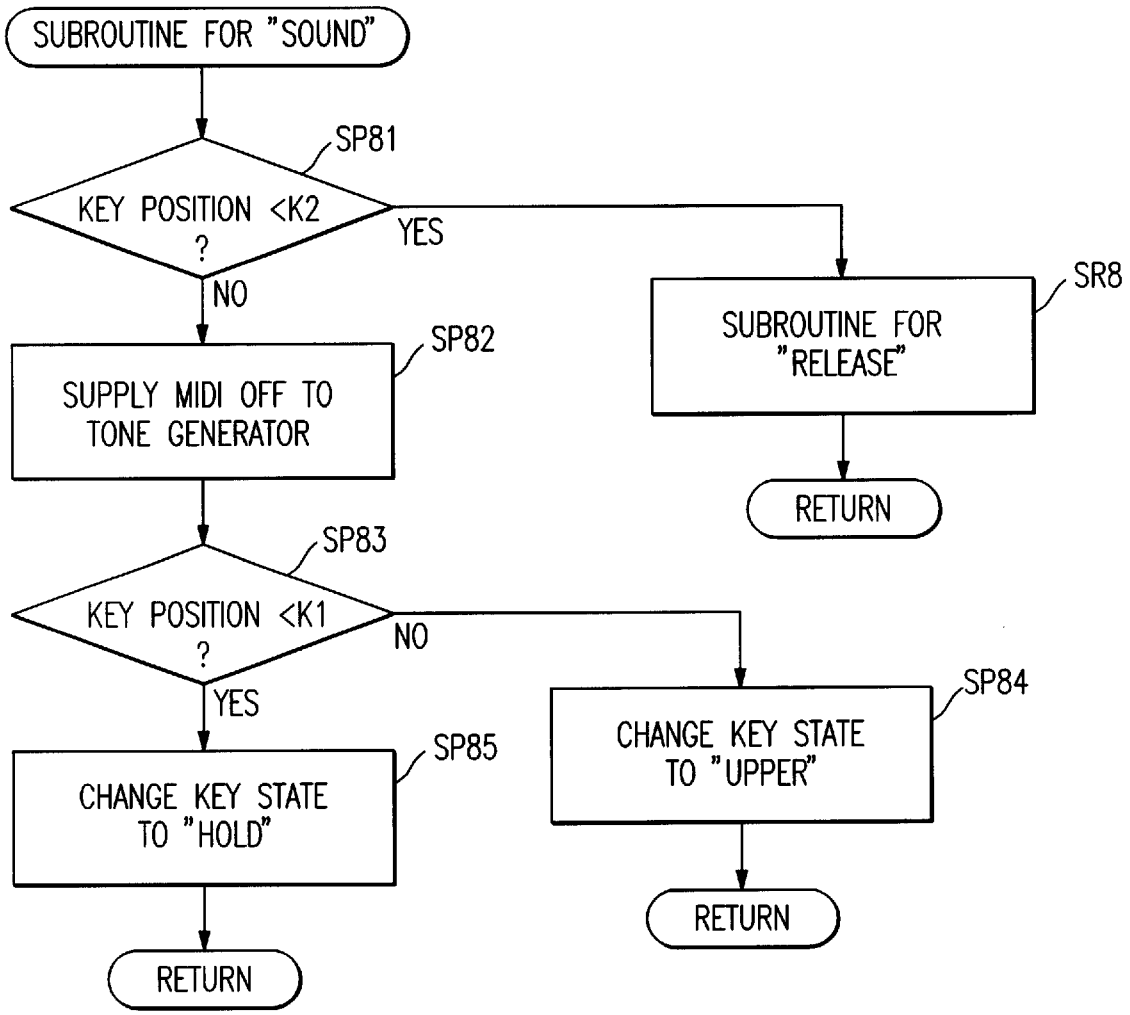
FIG. 22 is a flowchart showing a subroutine for "SOUND"

Turning back to FIG. 18, if the key state has been changed to "CONT-DOWN-0", "COUNT-DOWN-1", "COUNT-DOWN-2" or "COUNT-DOWN-3", the answer at step SP36 is given affirmative, and the central processing unit 100*a* enters the subroutine SR3 for "COUNT-DOWN" shown in FIG. 21.

The central processing unit 100*a* firstly checks the internal register R3L to see whether or not the black/white key 3*a*/3*b* has downwardly passed the detecting point K2 as by step SP61. When the black/white key 3*a*/3*b* returned to the key position between detecting point K2 and the rest position, the answer at step SP61 is given negative, and the central processing unit 100*a* releases the column of the tone generation table from the black/white key 3*a*/3*b* as by step SP62. The released channel is assignable to another depressed black/white key 3*a*/3*b*. When the player cuts short or apart in the performing on the keyboard 3 in accordance with staccatos in a tune, the decision at step SP61 tends to be negative so that the central processing unit 100*a* releases the column of the tone generation table. This results in missing tones. However, the staccato notes are not many, and the manufacturer permits the automatic playing system 30 to ignore the staccatos.

Subsequently, the central processing unit 100*a* compares the current key position with the detecting point K1 to see whether or not the black/white key 3*a*/3*b* has passed the detecting point K1 as by step SP63. When the black/white key 3*a*/3*b* returned to the rest position or the vicinity thereof, the answer at step SP63 is given negative, and the central processing unit 100*a* changes the piece of control data information representative of the key state from "COUNT-DOWN-0/1/2/3" to "UPPER" as by step SP64. The central processing unit 100*a* returns to the step SP32 in the main routine.

On the other hand, when the black/white key 3*a*/3*b* was between the detecting points K1 and K2, the answer at step SP63 is given affirmative, and the central processing unit 100*a* changes the piece of control data information representative of the key state from "COUNT-DOWN-0/1/2/3" to "HOLD" as by step SP65. The central processing unit 100*a* returns to the step SP32 in the main routine.

If the black/white key 3*a*/3*b* has passed the detecting point K2, the answer at step SP61 is given affirmative, and the central processing unit 100*a* checks the current key state to see whether or not the black/white key 3*a*/3*b* is in the key state "COUNT-DOWN-2/3". When the answer at step SP66 is given affirmative, the central processing unit 100*a* returns to the step SP32 in the main routine. If the answer at step SP66 is given negative, the central processing unit 100*a* checks the internal register R3L to see whether or not the black/white key 3*a*/3*b* has passed the detecting point K3 as by step SP67. When the black/white key 3*a*/3*b* is moving between the detecting points K2 and K3, the answer at step SP67 is given negative, and keeps the key state "COUNT-DOWN-0" (see step SP55). Then, the central processing unit 100*a* returns to the step SP32 in the main routine.

If the black/white key 3*a*/3*b* has passed the detecting point K3, the answer at step SP67 is given affirmative, and the central processing unit 100*a* compares the current key position with the detecting point K4 to see whether or not the black/white key 3*a*/3*b* has passed the detecting point K4 as by step SP68. When the black/white key 3*a*/3*b* has not passed the detecting point K4, yet, the answer at step SP68 is given negative, and the central processing unit 100*a* checks the key state to see whether or not the black/white key 3*a*/3*b* has entered the key state "COUNT-DOWN-0" as by step SP69.

When the black/white key 3*a*/3*b* was moved through the detecting point K3 into the section between the detecting points K3 and K4, the answer at step SP69 is given affirmative, and the central processing unit 100*a* proceeds to step SP70. The central processing unit 100*a* changes the key state from "COUNT-DOWN-0" to "COUNT-DOWN-1" (see FIG. 16). The central processing unit subtracts the binary value of the digital key position signal S6 at the threshold K3 from the binary value of the digital key position signal S6 at the threshold K1 and the conversion time at the threshold K3 from the conversion time at the threshold K1. The binary value at the threshold K1 and the conversion time at the threshold K1 are read out from the tone generation table. However, the central processing unit 100*a* reads out the binary value at the threshold K3 and the conversion time at the threshold K3 from the internal registers R3L and E5, respectively. The central processing unit 100*a* determines the key velocity Vk on the basis of the calculations. The key velocity Vk is converted to the velocity by means of the conversion table TB2, and the velocity is further converted to the value to be counted down through the count-down table. The central processing unit 100*a* compares the velocity and the value already stored in the tone generation table with the new velocity and the new value. If the new velocity is greater than the previous velocity, the central processing unit 100*a* stores the new velocity and the new value in the tone generation table, because the player is assumed to accelerate the black/white key 3*a*/3*b*. The central processing unit 100*a* returns to the step SP32 in the main routine. If the black/white key 3*a*/3*b* is still in the key state "COUNT-DOWN-1", the answer at step Sp69 is given negative, and the central processing unit 100*a* immediately returns to the step SP32 in the main routine.

On the other hand, if the black/white key 3*a*/3*b* has passed the detecting point K4, the answer at step SP68 is given affirmative, and the central processing unit 100*a* checks the key state to see whether or not the black/white key 3*a*/3*b* is still in the key state "COUNT-DOWN-0" as by step SP71. If the black/white key 3*a*/3*b* passed the detecting points K3 and K4 in the single sampling period, the answer at step SP71 is given affirmative, and the central processing unit 100*a* proceeds to step SP72. The central processing unit 100*a* changes the key state to "COUNT-DOWN-3", and writes the maximum velocity "7F" and the values to be counted down into the tone generation table.

On the other hand, if the answer at step SP71 is given negative, the central processing unit 100*a* proceeds to step SP73. The central processing unit 100*a* calculates the key velocity S01 at the detecting point K1, the mean key velocity S24 between the detecting points K2 and K4 and the mean key velocity S14 between the detecting points K1 and K4. The binary value of the digital key position signal S6 immediately before the threshold K1 and the conversion time thereof are respectively stored in the rows "K0" and "K0-TIM" of the key table, and the binary value of the digital key position signal S6 immediately after the threshold K1 and the conversion time thereof are respectively stored in the rows "OVR-K1" and "OVK1-TIM" of the tone generation table. The key velocity S01 is calculated on the basis of the pieces of control data information stored in the rows "K0" and "K0-TIM" and the pieces of tone data information "OVR-K1" and "OVK1-TIM". Similarly, the binary value of the digital position signal S6 immediately after the threshold K2 and the conversion time thereof are stored in the tone generation table. However, the binary value of the digital key position signal S6, i.e., the current key position immediately after the threshold K4 and the conversion time thereof are read out from the internal registers R3L and E5. The key velocity S01, the mean key velocity S24 and the mean key velocity S14 may be stored in the general-purpose internal registers.

Upon completion of the calculation, the central processing unit 100*a* proceeds to step SP74, and compares the key velocity S01 with the mean key velocity S14 to see whether the key velocity S01 is less than the mean key velocity S14. When the key velocity S01 is less than the mean key velocity 814, the answer at step SP74 is given affirmative, and the central processing unit 100*a* proceeds to step SP75. The central processing unit 100*a* firstly changes the key state to COUNT-DOWN-2", and compares the mean key velocity with the velocity stored in the row "VELOCITY" of the tone generation table. If the mean key velocity S24 is greater than the velocity, the player accelerates the key motion, and the central processing unit 100*a* determines the value to be counted down. The central processing unit 100*a* stores the mean key velocity S24 and the value to be counted down in the row "VELOCITY" and the row "DWN_CNTR", respectively.

Figure 2:
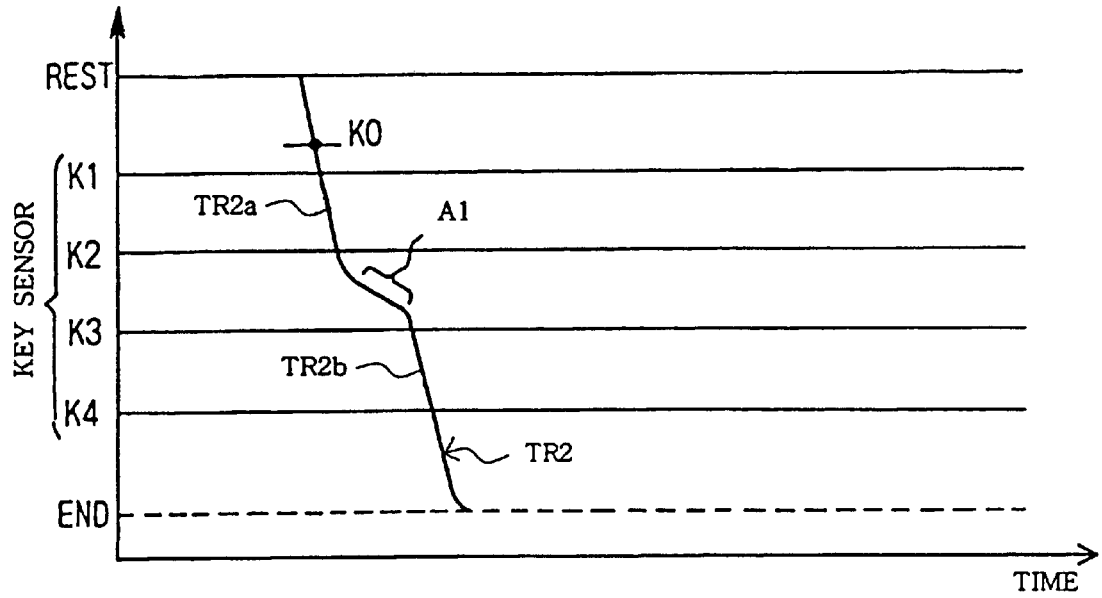
FIG. 2 PRIOR ART
FIG. 2 is a graph showing the trajectory of the black/white key in the abrupt key motion.

On the other hand, if the key velocity S01 is not less than the mean key velocity S14, the answer at step SP74 is given negative, and the central processing unit 100*a* proceeds to step SP76. The abrupt key motion (see FIG. 2) results in the key velocity S01 greater than the mean key velocity S14. The central processing unit 100*a* firstly changes the key state to "COUNT-DOWN-2", and determines the value to be counted down. The velocity in the row "VELOCITY" is replaced with the meant key velocity S14, and the value in the row "DWN_CNTR" is replaced with the new value to be counted down. Finally, the central processing unit 100*a* returns to the step SP32.

The key state has been changed to "SOUND". The answers at steps SP35, SP36, SP37 are given negative. The values stored in the row "DWN_CNTR" are decremented at every first interruption subroutine (see FIG. 13). When the value stored in a memory location of the row DWN_CNTR" reaches zero, the central processing unit 100*a* starts the tone generation through the channel, and changes the key state to "SOUND". Then, the answer at step SP36 is given affirmative, and the central processing unit 100*a* enters the subroutine SR4 for "SOUND" shown in FIG. 22.

The central processing unit 100*a* firstly checks the current key position to see whether or not the black/white key 3*a*/3*b* has upwardly passed the detecting point K2 as by step SP81. If the black/white key 3*a*/3*b* is upwardly moving the section between the detecting point K2 and the detecting point K1, the answer at step SPS1 is given negative, and the central processing unit 100*a* supplies a key-off signal MIDI OFF to the tone generator 100*f* as by step SP82. Then, the tone generator 100*f* rapidly damps the audio signal S2, and extinguishes the electronic sound.

Subsequently, the central processing unit 100*a* checks the current key position to see whether or not the black/white key has upwardly passed the detecting point K1 as by step SP83. If the black/white key 3*a*/3*b* enters the section over the detecting point K1, the answer at step SP83 is given negative, and the central processing unit 100*a* changes the key state to "UPPER" as by step SP84. Thereafter, the central processing unit 100*a* returns to the step SP32 in the main routine.

On the other hand, if the black/white key 3*a*/3*b* is still between the detecting, points K1 and K2, the answer at step SP83 is given affirmative, and the central processing unit 100*a* changes the key state to "HOLD" as by step SP85. Thereafter, the central processing unit 100*a* returns to the step SP32 in the main routine.

Figure 23:
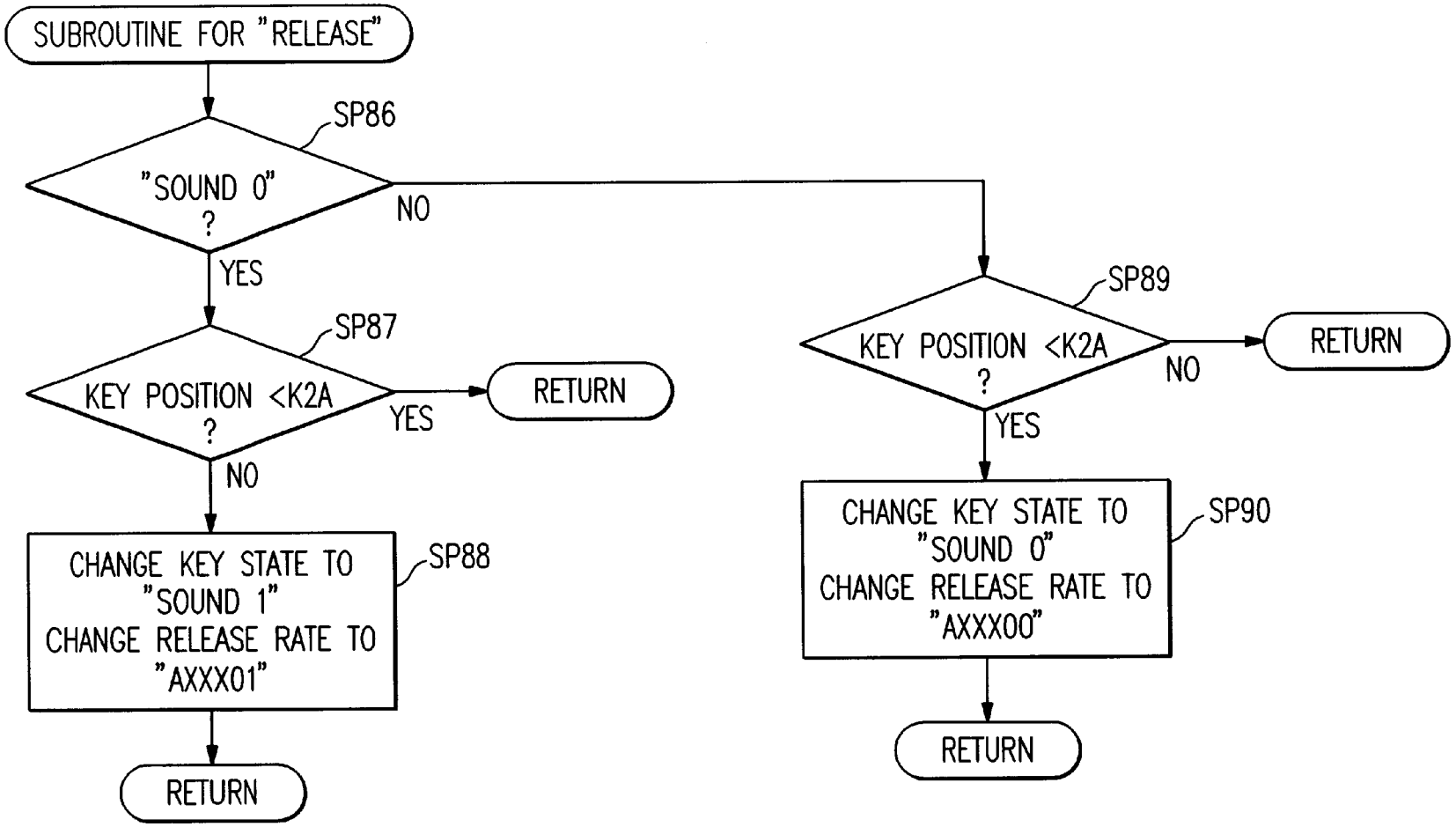
FIG. 23 is a flowchart showing a subroutine for "RELEASE"

If the black/white key 3*a*/3*b* is under the detecting point K2, the answer at step SPS1 is given affirmative, and the central processing unit 100*a* enters a subroutine for "RELEASE" SR8. The subroutine for "RELEASE" is illustrated in FIG. 23.

There are two kinds of key state "SOUND". The first kind of key state "SOUND" is referred to at step SP13, and is hereinbelow labeled with "SOUND 0". On the other hand, the other kind of key state "SOUND 1" relates to the detecting point K2A, and will be described hereinlater. In the subroutine for "RELEASE", the central processing unit 100*a* firstly examines whether or not the key state is "SOUND 0" as by step SP86. When the tone generator 100*f* starts to generate an electronic signal, the corresponding black/white key 3*a*/3*b* enters the key state "SOUND 0". For this reason, the central processing unit 100 firstly gives the answer at step SP86 affirmative. The central processing unit 100*a* proceeds to step SP87, and checks the current key position to see whether or not the black/white key 3*a*/3*b* is still under the detecting point K2A. If the black/white key 3*a*/3*b* is still in the deep key position, the answer at step SP87 is given affirmative, the central processing unit 100*a* returns through the subroutine for SOUND" to the step SP32 in the main routine.

On the other hand, if the black/white key 3*a*/3*b* has upwardly passed the detecting point K2A, the answer at step SP87 is given negative, and the central processing unit 100*a* changes the key state to "SOUND 1", and increases the release rate to "AXXX01" indicative of a large damping rate as by step SP88. The release rate "AXXX01" is a MIDI code, and no further description is incorporated hereinbelow. The tone generator 100*f* is responsive to the release rate "AXXX01" so as to accelerate the release in the envelope of the audio signal S2. As a result, the electronic sound is damped faster than an electronic sound in the natural damping. The central processing unit 100*a* returns through the subroutine for SOUND" to the step SP32 in the main routine.

On the other hand, if the key state has been already changed to "SOUND 1" the answer at step SP86 is given negative, and the central processing unit 100*a* checks the current key position to see whether or not the black/white key 3*a*/3*b* has upwardly passed the detecting point K2A as by step SP89. If the black/white key 3*a*/3*b* is over the detecting point K2A, the answer at step SP89 is given negative and the central processing unit 100*a* returns through the subroutine for "SOUND" to the step SP32 in the main routine.

On the other hand, if the black/white key 3*a*/3*b* has entered the section of the key trajectory under the detecting point K2A, the answer at step SP89 is given affirmative, and the central processing unit 100*a* proceeds to step SP90. The central processing unit 100*a* changes the key state to "SOUND 0" and the release rate to "AX XX 00". The release rate "AX XX 00" is also a MIDI code well known to skilled person. The release rate "AX XX 00" is smaller in damping rate than the release rate "AX XX 01". The tone generator 100*f* slowly decays the release in the envelope of the audio signal S2 at the release rate "AX XX 00", and the electronic sound is damped in the natural damping. The central processing unit 100*a* returns through the subroutine for "SOUND" to the step SP32 in the main routine. Thus, the controller 100 changes the release rate depending upon the depth of the black/white key 3*a*/3*b* with respect to the detecting point K2A, and delicately controls the damping of the electronic sounds. An acoustic piano damps the acoustic sound when the damper head is brought into contact with the strings. However, the damper head is not straightly brought into contact with the strings. If the player delicately fingers a black/white key 3*a*/3*b*, the black/white key 3*a*/3*b* makes the damper head dancing on the strings. The motion of damper head influences the damping of the acoustic sound. Similarly, when the release rate is appropriately changed, the electronic sound is damped like the acoustic piano. Thus, the controller 100 reproduces the delicate damping of the acoustic sound.

Figure 24:
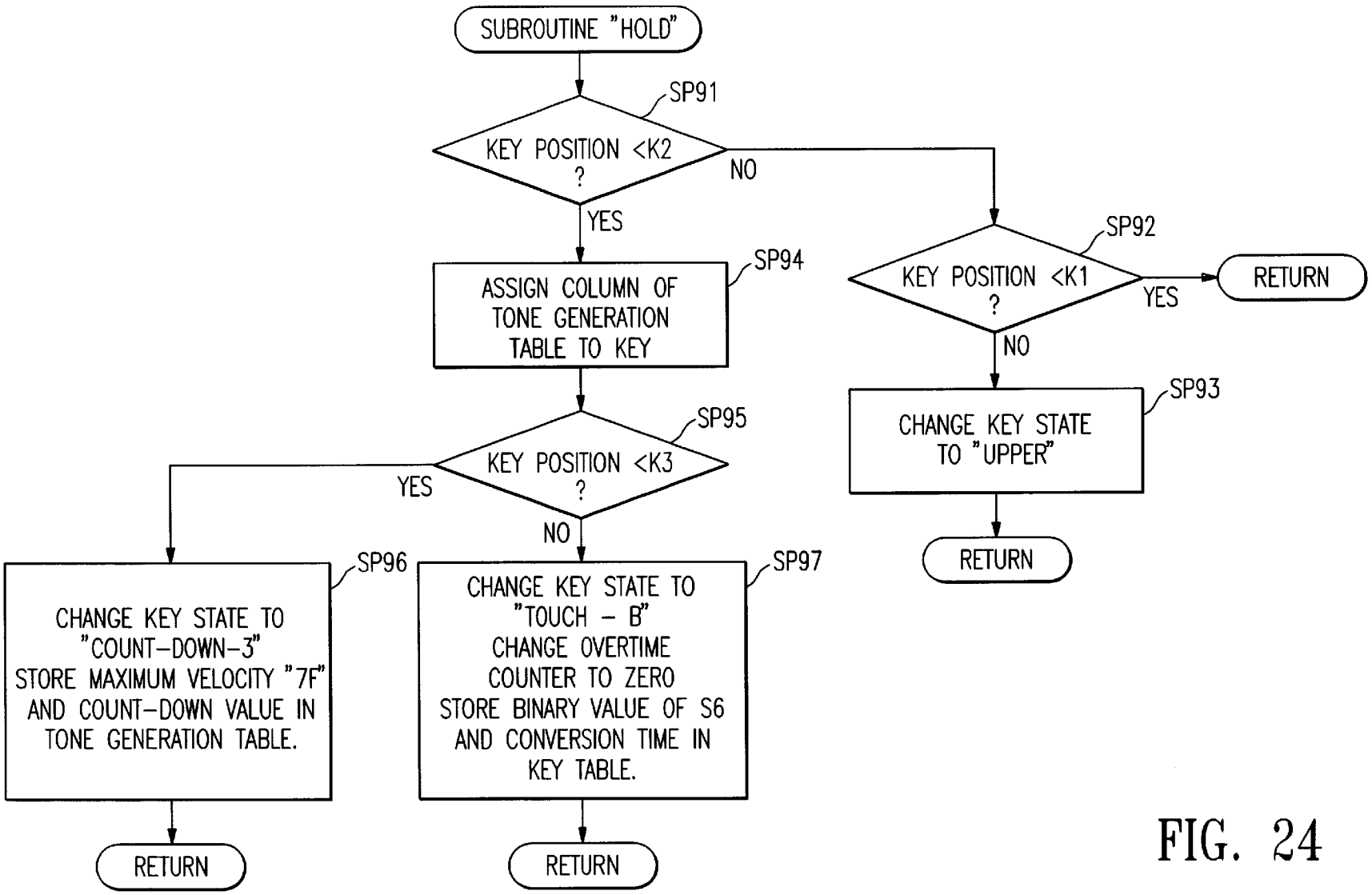
FIG. 24 is a flowchart showing a subroutine for "HOLD"
Figure 25:
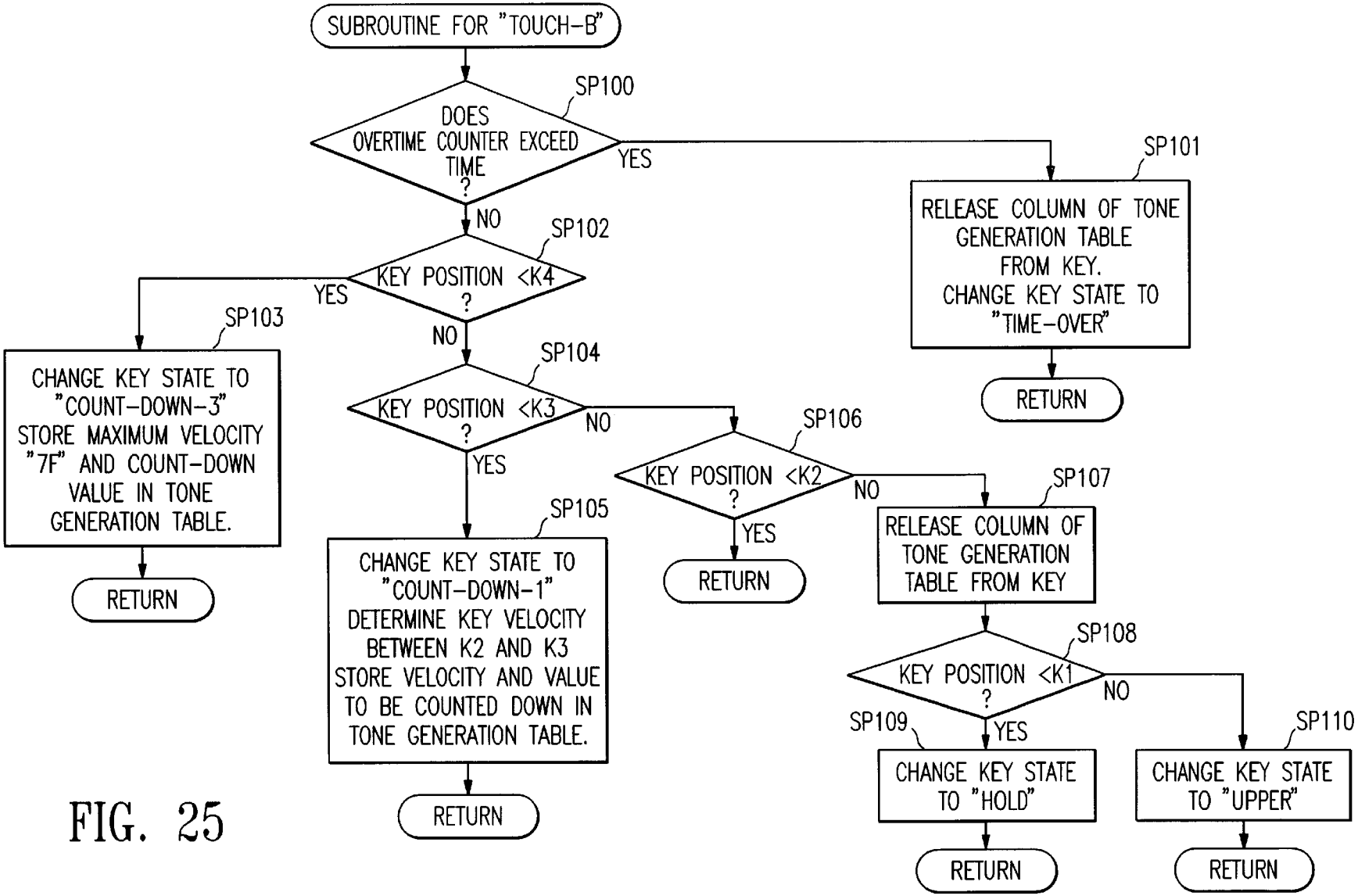
FIG. 25 is a flowchart showing a subroutine for "TOUCH-B"
Figure 26:
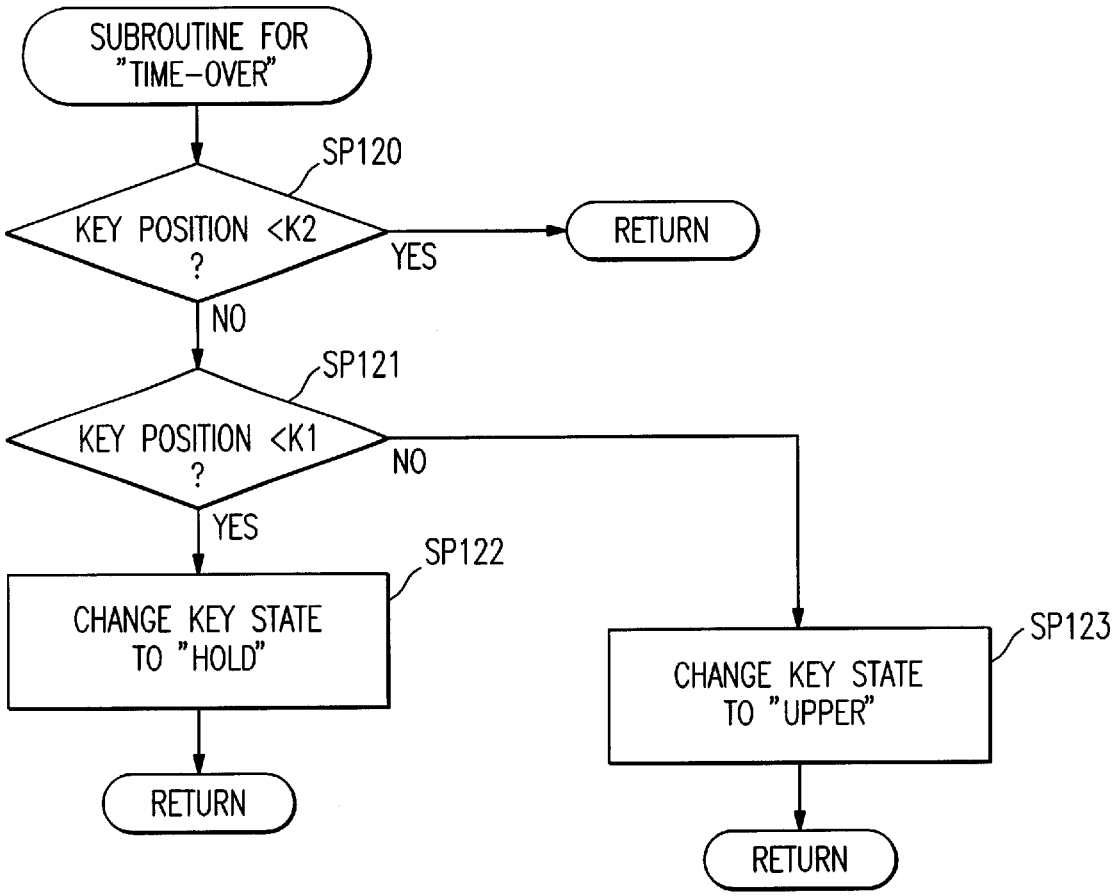
FIG. 26 is a flowchart showing a subroutine for "TIM-EOVER"

The key state "HOLD" is representative of a black/white key downwardly depressed under the detecting point K2 and, thereafter, returning to a key position between the detecting points K2 and K1 or a black/white key 3*a*/3*b* staying at a key position lower than the detecting point K1 but not lower than the detecting point K2 for a predetermined time. If the key state has been changed to "HOLD", the answers at steps SP35, SP36, SP37 and SP38 are given negative, and the answer at step SP39 is given affirmative. Then, the central processing unit 100*a* enters the subroutine "HOLD" SR5, and FIG. 24 illustrates the subroutine "HOLD".

The central processing unit 100*a* firstly checks the current key position to see whether or not the black/white key 3*a*/3*b* has downwardly passed the detecting point K2 as by step SP91. If the black/white key 3*a*/3*b* is over the detecting point K2, the answer at step SP91 is given negative. Then, the central processing unit 100*a* checks the current key position again to see whether or not the black/white key 3*a*/3*b* has downwardly passed the detecting point K1 as by step SP92. If the black/white key 3*a*/3*b* is still staying at the position lower than the detecting point K1 but not lower than the detecting point K2, the answer at step SP92 is given affirmative, and the central processing unit 100*a* returns to the step SP32 in the main routine.

On the other hand, if the black/white key 3*a*/3*b* had upwardly passed the detecting point K1, the answer at step SP92 is given negative, and the central processing unit 100*a* changes the key state to "UPPER" as by step SP93. The central processing unit 100*a* returns to the step SP32 in the main routine.

If the player depresses the black/white key 3*a*/3*b* under the detecting point K2, the answer at step SP91 is given affirmative, and the central processing unit 100*a* assigns a column of the tone generation table to the black/white key 3*a*/3*b* as by step SP94. However, if all the columns have been already assigned to other black/white keys 3*a*/3*b*, the central processing unit passes the step SP94 without execution.

Subsequently, the central processing unit 100*a* checks the current key state to see whether or not the black/white key 3*a*/3*b* has downwardly passed the detecting point K3 as by step SP95. If the player strongly depresses the black/white key 3*a*/3*b,* the black/white key 3*a*/3*b* passes two detecting points K2 and K3 in the single sampling period, and the central processing unit 100*a* proceeds to step SP96.

In the step SP96, the central processing unit 100*a* firstly changes the key state to "COUNT-DOWN-3", and gives the maximum velocity "7F" to the black/white key 3*a*/3*b*. The central processing unit 100*a* determines the value to be counted down, and stores the piece of tone data information representative of the maximum velocity "7F" and the count-down values in the row "VELOCITY" and the row "DWN_CNTR", respectively. Then, the central processing unit 100*a* returns to the step SP32 in the main routine.

On the other hand, if the black/white key 3*a*/3*b* is moving between the detecting points K2 and K3, the answer at step SP95 is given negative, and the central processing unit 100*a* proceeds to step SP97. In the step SP97, the central processing unit 100*a* firstly changes the key state to "TOUCH-B", and changes the associated overtime counter to zero. The central processing unit 100*a* transfers the current key position and the conversion time from the internal registers R3L and E5 to the memory location of the row "OVR-K2" assigned to the channel and the memory location of the row "OVK2-TIM" also assigned to the channel, and stores the pieces of tone data information representative of the current key position and the conversion time therein. Thus, the key position and the conversion time are memorized in the tone generation table for the black/white key 3*a*/3*b* passing the detecting point K2.

Turning back to FIG. 18, if the black/white key 3*a*/3*b* is depressed after entry into the key state "HOLD" without return to the rest position, all the answers at steps SP35, SP36, SP37, SP38, SP39 and SP40 are given negative, and the central processing unit 100*a* enters the subroutine for "TOUCH-B" SR7.

The central processing unit 100*a* firstly checks the associated overtime counter to see whether or not the counter exceeds the predetermined time as by step SP100. If the value stored in the overtime counter indicates that the predetermined time has been already expired, the answer at step SP100 is given affirmative, and the central processing unit 100*a* proceeds to step SP101. In the step SP101, the central processing unit 100*a* releases the column of the tone generation table from the black/white key 3*a*/3*b,* and changes the key state to "TIME-OVER". Thereafter, the central processing unit 100*a* returns to the step SP32 in the main routine.

On the other hand, if the associated overtime counter stores the value indicative of a time shorter than the predetermined time, the answer at step SP100 is given negative, and the central processing unit 100*a* proceeds to step SP102. The central processing unit 100*a* checks the current key position to see whether or not the black and white key 3*a*/3*b* has downwardly passed the detecting point K4 as by step SP102. If the black/white key 3*a*/3*b* has already passed the two detecting points K3 and K4, the answer at step SP102 is given affirmative, and the central processing unit 100*a* proceeds to step SP103. The central processing unit 100*a* changes the key state to "COUNT-DOWN-3", and gives the maximum value "7F" to the velocity. The central processing unit 100*a* determines the value to be counted down on the basis of the velocity "7F", and stores the maximum velocity and the value to be counted down in the memory location of the row "VELOCITY" assigned to the associated channel and in the memory location of the row "DWN_CNTR" also assigned thereto. Thereafter, the central processing unit 100*a* returns to the step SP32 in the main routine.

If the answer at step SP102 is given negative, the central processing unit 100*a* proceeds to step SP104, and checks the current key position to see whether or not the black/white key 3*a*/3*b* has downwardly passed the detecting point K3. When the black/white key 3*a*/3*b* is in the section between the detecting points K3 and K4, the answer at step SP104 is given affirmative, and the central processing unit 100*a* proceeds to step SP105. The central processing unit 100*a* firstly changes the key state to "COUNT-DOWN-1", and calculates the key velocity between the detecting points K2 and K3. The binary value of the digital positional signal S6 at the detecting point K2 and the conversion time are read out from the tone generation table, and the binary value of the digital positional signal S6 at the detecting point K3 and the conversion time are read out from the internal registers R3L and E5. The key velocity is converted to the velocity, and the value to be counted down is determined on the basis of the velocity as shown in FIG. 11. Finally, the central processing unit 100*a* stores the velocity and the value to be counted down in the memory location of the row "VELOCITY" assigned to the associated channel and in the memory location of the row "DWN_CNTR" also assigned thereto. Upon completion of the jobs, the central processing unit 100*a* returns to the step SP32 in the main routine.

If the answer at step SP104 is given negative, the central processing unit 100*a* checks the current key position to see whether or not the black/white key has downwardly passed the detecting point K2 as by step SP106. When the black/white key 3*a*/3*b* is in the section between the detecting points K2 and K3, the answer at step SP106 is given affirmative, and the central processing unit 100*a* returns to the step SP32 in the main routine.

On the other hand, if the answer at step SP106 is given negative, the central processing unit 100*a* releases the column of the tone generation table from the black/white key 3*a*/3*b* as by step SP107, and the released column is available for the tone generation on other black/white keys 3*a*/3*b*.

Subsequently, the central processing unit 100*a* checks the current key position to see whether or not the black/white key 3*a*/3*b* has downwardly passed the detecting point K1 as by step SP108. If the answer at step SP108 is given affirmative, the central processing unit 100*a* changes the key state to "HOLD", and, thereafter, returns to the step SP32 in the main routine. On the other hand, if the answer at step SP108 is given negative, the central processing unit 100*a* changes the key state to "UPPER", and, thereafter, returns to the step SP32 in the main routine.

Turning back to FIG. 18, if the key state is "TIME-OVER", the answer at step SP35, SP36, SP37, SP38 and SP39 are given negative, and the answer at step SP40 is given affirmative. Then, the central processing unit 100*a* enters the subroutine for "TIME-OVER" shown in FIG. 26. The central processing unit 100*a* checks the current key position to see whether or not the black/white key 3*a*/3*b* is under the detecting point K2 as by step SP120. If the black/white key 3*a*/3*b* is still lower than the detecting point K2, the answer at step SP120 is given affirmative, and the central processing unit 100*a* returns to the step SP32 in the main routine. Thus, the key state is unchanged after the entry into the key state "TIME-OVER". Even if the black/white key 3*a*/3*b* reaches the end position after the entry into the key state "TIME-OVER", any electronic sound is generated. If a player keeps a black/white key of an acoustic piano between the detecting points K2 and K3 for the predetermined time, further key motion does not result in a strike of strings with a hammer, and any acoustic sound is not generated. Thus, the subroutine for "TIME-OVER" makes the generation of electronic sounds similar to that of the acoustic piano.

On the other hand, if the black/white key 3*a*/3*b* is over the detecting point K2, the answer at step SP120 is given negative, and the central processing unit 100*a* checks the current key position to see whether or not the black/white key 3*a*/3*b* is under the detecting point K1 as by step SP121. If the black/white key 3*a*/3*b* is between the detecting points K2 and K1, the answer at step SP121 is given affirmative, and the central processing unit 100*a* changes the key state to "HOLD" as by step SP122. Thereafter, the central processing unit 100*a* returns to the step SP32 in the main routine. On the other hand, if the black/white key 3*a*/3*b* has upwardly passed the detecting point K1, the answer at step SP123 is given negative, and the central processing unit 100*a* changes the key state to "UPPER" as by step SP123. Thereafter, the central processing unit 100*a* returns to the step SP32 in the main routine. Even if the player allows the black/white key 3*a*/3*b* to return over the detecting point K2, further downward key motion releases the black/white key 3*a*/3*b* from the key state "TIME-OVER", and the tone generator can generate the electronic sounds in response to the key motions of the released keys.

Figure 27:
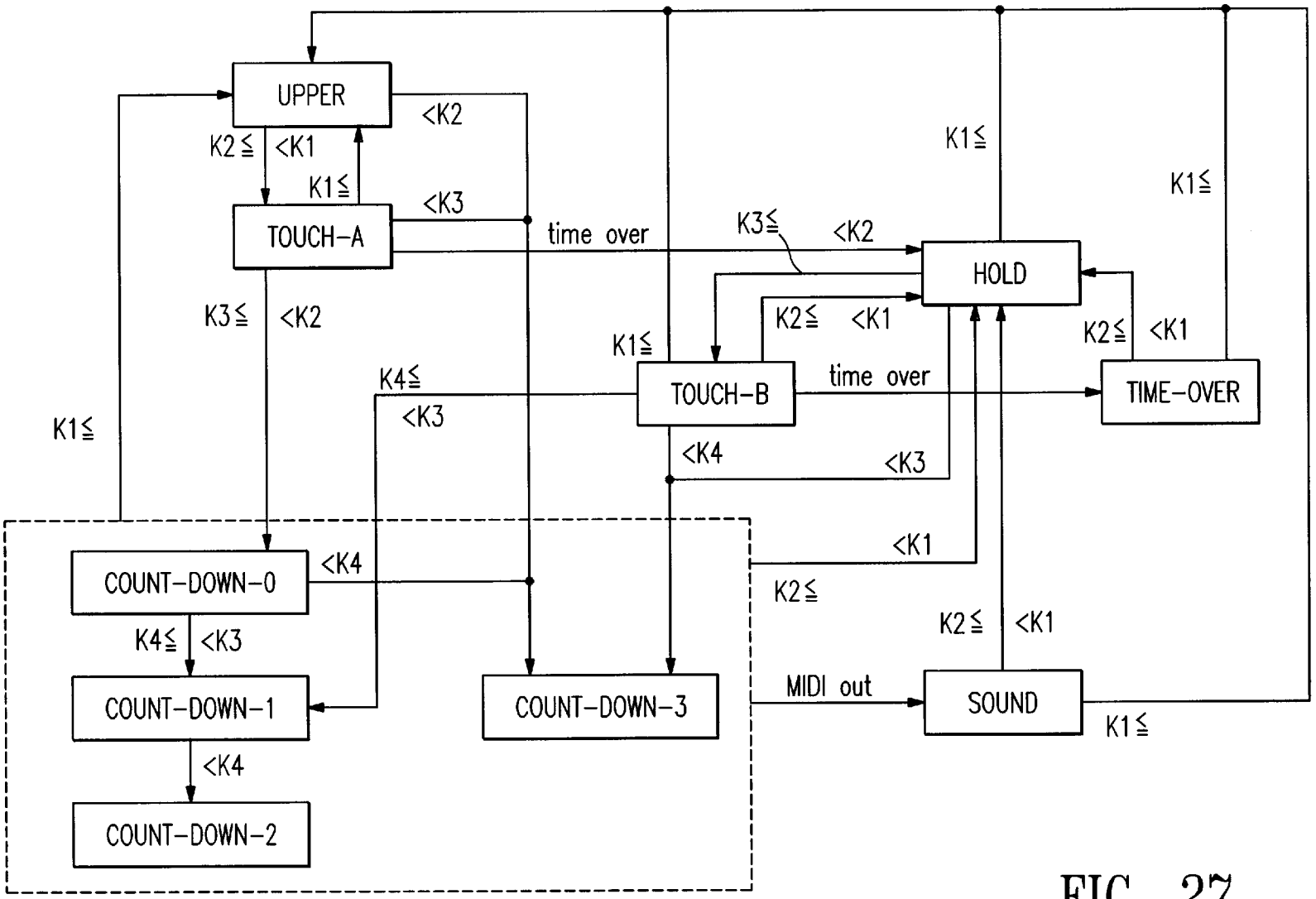
FIG. 27 is a diagram showing a transfer of control between the subroutines.

As described hereinbefore, the interruption subroutines (see FIGS. 13 and 15), the main routine (see FIG. 18) and the subroutines (see FIGS. 19 to 26) are linked with one another, and the control is transferred therebetween as shown in FIG. 27.

Control Sequence Along Actual Key Motions

Description is hereinbelow made on the control sequence of the automatic player piano. The silent system 20 is changed to the block position, and does not allow the hammers 6 to strike the associated strings 7. A player is assumed to give rise to the key motions shown in FIGS. 8, 16 and 17.

Figure 16:
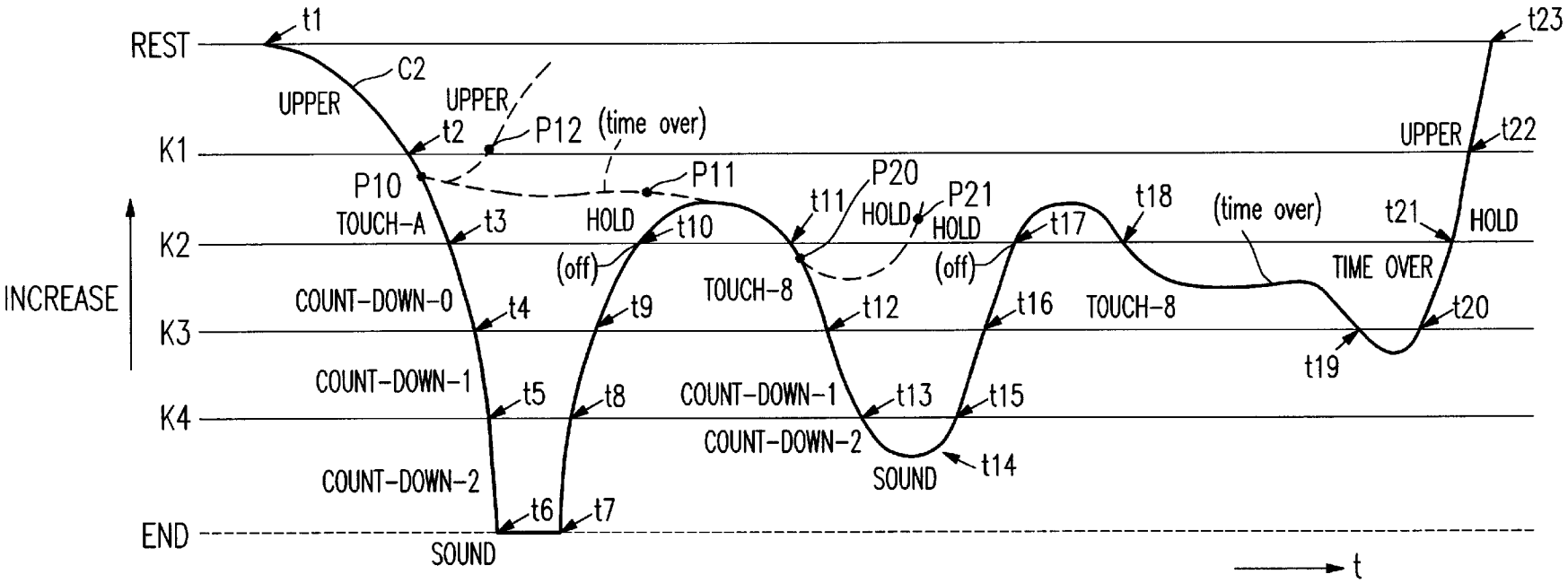
FIG. 16 is a graph showing variation of key state together with a black/white key.

Firstly, FIG. 16 is referred to. The black/white key 3*a*/3*b* is staying at the rest position before time t1, and starts the key motion at time t1. The key state "UPPER" is initially stored in the row "KEY_STATE" of the key table, and the central processing unit 100*a* processes the data information along the subroutine "UPPER" immediately after the initiation. While the black/white key 3*a*/3*b* is downwardly moving, in the section between the rest position and the detecting point K1, the central processing unit 100*a* repeatedly returns from the subroutine "UPPER" through the step SP42, and does not change the key state.

The black/white key 3*a*/3*b* passes the detecting point K1 at time t2. Then, the central processing unit 100*a* assigns a column of the tone generation table for a tone generation through steps SP43, SP44 and SP45, and changes the key state to "TOUCH-A" (see step SP45). As a result, the central processing unit 100*a* changes the control sequence from the subroutine for "UPPER" to the subroutine for "TOUCH-A" shown in FIG. 20.

The black/white key 3*a*/3*b* passes the detecting point K2 at time t3. The central processing unit 100*a* determines the velocity and the value to be counted down, and stores them in the tone generation table through steps SP51, SP53, SP54 and SP55. The central processing unit 100*a* changes the key state to "COUNT-DOWN", and the control is transferred from the subroutine "TOUCH-A" to the subroutine for "COUNT-DOWN" shown in FIG. 21.

The black/white key 3*a*/3*b* passes the detecting point K3 at time t4. The central processing unit 100*a* determines the velocity and the value to be counted down through steps SP67, SP68, SP69 and SP70, and changes the key state to "COUNT-DOWN-1".

The black/white key 3*a*/3*b* passes the detecting point K4 at time t5. The central processing unit 100*a* determines the velocity and the value to be counted down through the steps SP68, SP71 and SP72, and changes the key state to "COUNT-DOWN-2". Although the velocity is recalculated at the detecting points K3 and K4, a larger velocity and the associated value to be counted down are left in the tone generation table. Thus, the largest velocity and the associated value to be counted down are finally left in the tone generation table. The value to be counted down is decremented at every interruption subroutine (see step SP13). When the counter reaches zero, the tone generator starts to generate the audio signal at time t6, and the central processing unit 100*a* changes the key state to "SOUND".

The black/white key 3*a*/3*b* is released at time t7, and is upwardly moved. The black/white key 3*a*/3*b* upwardly passes the detecting point K2 at time t10, and the central processing unit 100*a* instructs the tone generator 100*f* to stop the tone generation. The central processing unit 100*a* changes the key state to "HOLD" through the steps Sp81, SP82, SP83 and SP85.

The black/white key 3*a*/3*b* is depressed, again. Then, a column of the tone generation table is assigned to the black/white key 3*a*/3*b* through the steps SP91, SP94, SP95 and SP97, and the key state is changed to "TOUCH-B". The black/white key 3*a*/3*b* is further depressed, and the key state is changed to "COUNT-DOWN", again. The count-down value reaches zero at time t14, and the central processing unit 100*a* instructs the tone generator 100*f* to generate the electronic sound.

The player releases the black/white key 3*a*/3*b*, and the key state is changed to "HOLD" at time t17. The player depresses the black/white key 3*a*/3*b*, again. The black/white key 3*a* /3*b* passes the detecting point K2 at time t18, and the key state is changed to "TOUCH-B". The player keeps the black/white key 3*a* /3*b* in the key state "TOUCH-B" for the predetermined time, and the black/white key 3*a*/3*b* enters the key state "TIME-OVER". Although the player depresses the black/white key 3*a*/3*b* after the entry into the key state "TIME-OVER", the key state is unchanged, and any count-down value is stored for the black/white key 3*a* /3*b*. For this reason, any electronic sound is not generated.

The black/white key 3*a*/3*b* is upwardly moved, and passes the detecting point K2 at time t21 and the detecting point K1 at time t22. Accordingly, the they state is changed to "HOLD" at time t21 and "UPPER" at time t22. This is the control sequence for the key motion indicated by the real line in FIG. 16.

On the contrary, if the player continuously keeps the black/white key 3*a*/3*b* in the key state "TOUCH-A" from point P10 as indicated by broken line, the predetermined time is expired at point P11. However, the black/white key 3*a*/3*b* enters the key state "HOLD" through the steps SP51 and SP52. If the player releases the black/while key 3*a*/3*b* at point P10, the black/white key 3*a* /3*b* returns to the section over the detecting point K1 as indicated by another broken line, and enters the key state "UPPER" at point P12 through the step s SP57 and SP58.

Furthermore, if the player releases the black/white key 3*a*/3*b* at point P20, the black/white key 3*a*/3*b* is moved from point P20 through point P21 along broken line, and enters the key state "HOLD" (see steps SP108 and SP109).

Subsequently, description is made on the control sequence for the key motion shown in FIG. 17. The key motion shown in FIG. 17 contains two parts both classified into the abrupt key motion. The first part is from point P1 to point P2, and the black/white key 3*a*/3*b* passes the thresholds K1 and K2 in a certain sampling period of the key sensors 90. The black/white key 3*a*/3*b* enters the key state "COUNT-DOWN-3" through the steps SP41, SP43, SP44 and SP46, and the tone generator 100*f* generates the electronic sound at the maximum velocity "7F".

The second part is from point P3 to point P4, and the black/white key 3*a*/3*b* passes the thresholds K2 and K3 in another sampling period. The black/white key 3*a*/3*b* enters the key state "COUNT-DOWN-3" through the steps SP91, SP94, SP95 and SP96, and the tone generator 100*f* generates the electronic sound at the maximum velocity "7F".

Finally, when the black/white key 3*a*/3*b* repeatedly crosses the detecting point K2A as shown in FIG. 8, the central processing unit 100*a* changes the release rate through the control sequence shown in FIG. 23, and the electronic sounds are delicately damped.

As will be understood from the foregoing description, the automatic player piano according to the present invention achieves the following advantages.

First, the manufacturer gives the coefficients ri to the controller 100, and the central processing unit multiplies the binary value at the rest position by the coefficients ri. The produces are indicative of the binary values at the detecting points K1, K2, K3, K4 and K2A. Thus, the manufacturer appropriately determines the detecting points and, accordingly, the thresholds K1, K, K3, K4 and K2A.

Second, the space between the rest position and the end position is divided into the plural sections, and the controller 100 discriminates various kinds of key motions, such as a key motion in the section between the rest position and the detecting point K1 and a key motion in the section under the detecting point K4. Accordingly, the tone generator 100*f* appropriately controls the loudness, the damping rate and so fourth.

Third, the thresholds K1, K2, K3, K4 and K2A are changeable. This means that the controller can correct installation errors of the key sensors 90 on the key bed 4*a* through the calibration.

Fourth, the key state such as "TOUCH-A", "COUNT-DOWN-0", "TOUCH-B" and "HOLD" is determined on the basis of the previous key state and the current key position. The controller takes the current key position, the previous key state and the duration in the previous key state into account for the key state "TIME-OVER" and the key state "HOLD". Thus, the central proccssing unit 100*a* exactly recognizes the current key state, and appropriately instructs the tone generator 100*f* to generate the electronic sounds. The electronic sounds contain details of the acoustic piano sounds. For example, the detecting point K2A is provided at a certain point on the trajectory of each black/white key 3*a*/3*b*, and the associated damper head is brought into contact with the strings at the certain point. The tone generator changes the release rate depending upon the key motion around the detecting point K2A. As a result, the electronic sound is damped like the acoustic piano sound.

Fifth, the controller 100 discriminates the abrupt key motion from the ordinary key motion. The central processing unit 100*a* calculates the key velocity in the different spans, i.e., the key velocities S01, S24 and S14, and determines the velocity after the comparison (see the step SP74). As described hereinbefore, the abrupt key motion has the step A1 (see FIG. 2), and the step A1 takes place in any one or ones of the sections. A step A1 extends from the section K1–K2 to the section K3–K4. In this situation, if the central processing unit 100*a* calculates the key velocity in a particular section at all times, the key velocity does not exactly reflect the velocity or the intensity of the impact. The central processing unit 100*a* determines the key velocity in the span between the detecting point K1 and the detecting point K4 for the abrupt key motion, and eliminates the error due to the step A1 from the velocity.

In the above-described embodiment, the black/white keys 3*a*/3*b* serve as manipulators, respectively. The sections between the detecting points K1, K2, K2A, K3, K4 are corresponding to four of sections defined in space between the rest position and the end position.

Modification

In the above-described embodiment, when the black/white key 3*a*/3*b* passes each of the detecting points K2, K3 and K4, the central processing unit 100*a* repeatedly calculates the key velocity, and the velocity and the count-down value are changed to new ones under the conditions that the new velocity is greater than the previous one. However, another embodiment determines the key velocity S01, S14 and S24. When the black/white key 3*a*/3*b* passes the detecting point K4, the central processing unit 100*a* compares the key velocity S01 with the key velocity S14. If the key velocity S01 is less than the key velocity S14, the central processing unit 100*a* employs the key velocity S24 as the velocity, and determines the count-down value on the basis of the key velocity S24. On the other hand, if the key velocity S01 is greater than the key velocity S14, the central processing unit 100*a* employs the key velocity S14 as the velocity, and determines the count-down value on the basis of the key velocity S14.

In the above-described embodiment, the central processing unit employs the key velocity S24 for the ordinary key motion and the key velocity S14 for the abrupt key motion. As a result, the span for the ordinary key motion contains the span for the ordinary key motion. In another embodiment, the span for the ordinary key motion is partially overlapped with the span for the abrupt key motion. Otherwise, the span for the ordinary key motion may be spaced from the span for the abrupt key motion.

In the above-described embodiment, the tone generator 100*f* generates the electronic sounds, the tone-color of which is like that of an acoustic piano. In another embodiment, the tone generator 100*a* stores an envelope different from that of an acoustic piano, and give a different tone-color to the electronic sounds. The damping rate is controlled as similar to the above-described embodiment. The envelop control may be applied to another part of the envelop such as the sustain.

The present invention is applicable to any kind of keyboard musical instrument such as, for example, an electric keyboard without any key action mechanism. The present invention may be further applied to a manipulator except the black/white keys 3*a*/3*b*.

The key position signal S3 is available for a feedback signal representative of the current key position in the automatic playing using the key actuators 30.

In the above-described embodiment, the span for calculating the key velocity is different depending upon the key state. The key velocity is calculated on the basis of the key motion between the detecting point K1 and the detecting point K2 in the key state "TOUCH-A", the key velocity is calculated on the basis of the key motion between the detecting point K1 and the detecting point K3 in the key state "COUNT-DOWN-0", and the key velocity is calculated on the basis of the key motion between the detecting point K2 and the detecting point K4 in the key state "COUNT-DOWN-1". However, the span used for the calculation is never limited to the above. In another embodiment, the key velocity is calculated on the basis of the key motion from the detecting point K2 and the detecting point K3 in the key state "COUNT-DOWN-0".

Figure 28:
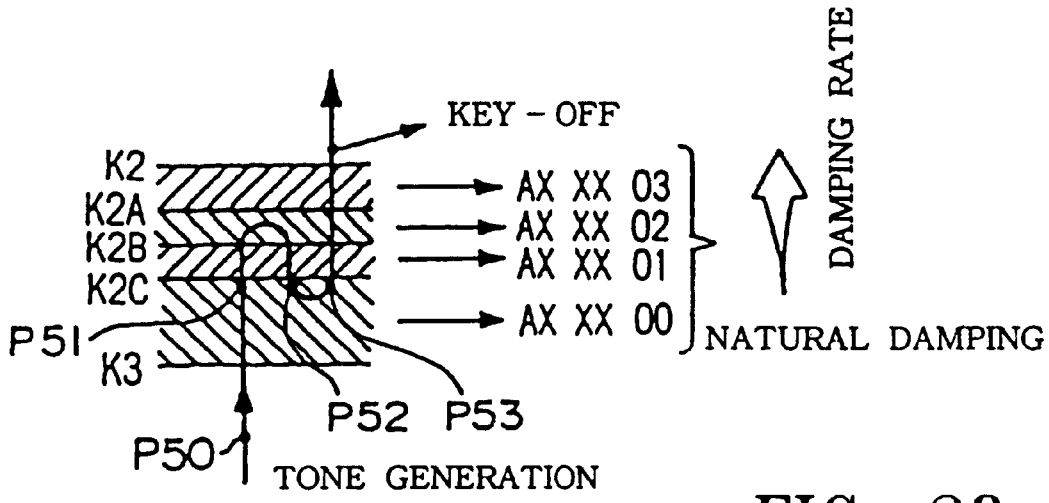
FIG. 28 is a view showing detecting points defined in another keyboard musical instrument according to the present invention.

In the above-described embodiment, the detecting points K1, K2, K2A, K3 and K4 divide the space between the rest position and the end position into the sections. In another embodiment, three detecting points K2A, K2B and K2C are provided in the section between the detecting points K2 and K3 as shown in FIG. 28. Although the detecting points are increased, any additional sensor is not required, because the thresholds K1, K2, K2A, K2B, K2C, K3 and K4 corresponding to the detecting points K1 to K4 are determined through the calculation using the coefficients ri. Of course, more than three detecting points may be provided between the detecting points K2 and K3. Thus, the increase of detecting points does not result in cost-up.

Figure 29:
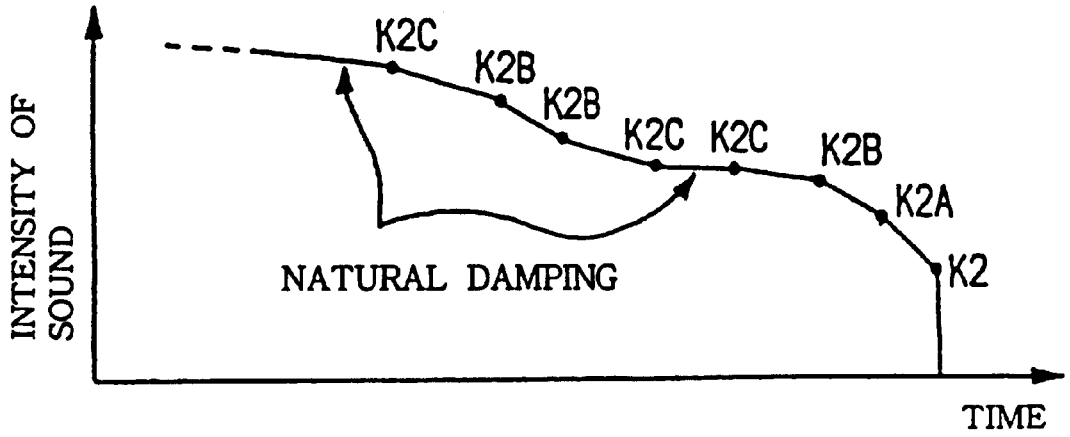
FIG. 29 is a graph showing the relation between a part of an envelop of an electronic sound generated in the keyboard musical instrument and lapse of time.

The damping rate is varied as "AX XX 00", "AX XX 01", "AX XX 02" and "AX XX 03". The damping rate "AX XX 00" is representative of the natural damping, and the damping rage is increased from "AX XX 00" to "AX XX 03". An electronic sound is generated at point P50, and is damped at the natural damping rate between the points P50 and P51 and between the points P52 and P53. The damping rate is increased and, thereafter, decreased between the points P51 and P52, and is increased from the point P53 and the key-off point. As a result, the electronic sound has the envelope shown in FIG. 29. Thus, the electronic sounds are closer to the acoustic sound rather than the electronic sounds generated by the above-described embodiment.

Finally, the central processing unit 100*a* compares the new velocity with the previous velocity to determine whether or not the count-down value is renewed. In another embodiment, the central processing unit 100*a* directly compares the new count-down value with the previous count-down value to determine whether or not the central processing unit 100*a* is to replace the previous count-down value with the new count-down value. The direct comparison is expected to enhance the accuracy. When, the present inventors investigated the indirect comparison and the direct comparison, there is not any significant difference between them. However, the indirect comparison is desirable for the simplification of data processing.

Although particular embodiments of the present invention has been shown and described, it will be obvious to those skilled in the art that various changes and modifications may be made without departing from the spirit and scope of the present invention.

The catcher stopper 2*a* may be driven for rotation by means of a pedal or a knob linked therewith. The catcher stopper 2*a* may be replaced with a shank stopper, on which the hammer shanks rebound before striking the sets of strings 7. Any kind of stopper is available for rebounding the hammers 6.

The music data codes representative of the performance may be transferred to another automatic player piano through a suitable channel.

In the subroutine for "COUNT-DOWN", the central processing unit 100*a* may not have step SP62. In this instance, the electronic sounds are generated for the staccatos.

The present invention may be applied to a silent piano, i.e., the combination of an acoustic piano and the silent system or a standard automatic player piano, i.e., the combination of an acoustic piano and the automatic playing system.

What is claimed is:

1. A keyboard musical instrument comprising manipulators movable through a space divided into sections between respective rest positions of said manipulators and respective end positions of said manipulators, sensors respectively provided for said manipulators and measuring trajectories of the associated manipulators in said sections, a controller connected to said sensors and calculating a section velocity of each of said manipulators in each of said sections so as to determine the trajectory of each manipulator to be categorized in one of kinds of the motions of said manipulators on the basis of the values of said section velocity respectively calculated in said sections, and a tone generator connected to said controller and regulating an attribute of a sound to be produced in response to said each manipulator to an appropriate value on the basis of one of said values of said section velocity selected depending upon said one of the kinds of said motions.

2. The keyboard musical instrument as set forth in claim 1, in which said one of said kinds of motions has a first trajectory having a first part represented by a first value of said section velocity and a second part closer to said end position than said first part and represented by a second value of said section velocity less than said first value, and another of said kinds of motions has a third part represented by a third value of said section velocity and a fourth part closer to said end position than said third part and represented by a fourth value of said section velocity greater than said third value, said controller discriminating said one of said kinds of motions from said another of said kinds of motions on the basis of variation of said section velocity.

3. The keyboard musical instrument as set forth in claim 2, in which said controller further calculates a velocity significant to said attribute for said one of said manipulators on the basis of a portion of said first trajectory, said portion of said first trajectory being longer than a portion of said second trajectory.

4. The keyboard musical instrument as set forth in claim 3, in which said manipulators form in combination a keyboard.

5. The keyboard musical instrument as set forth in claim 4, further comprising key action mechanisms connected to said manipulators, hammers driven for rotation by said key action mechanisms, respectively, strings to be struck with said hammers, respectively, and damper mechanisms respectively linked with said manipulators and changed between a contact state and a spaced state by the associated manipulators, respectively.

6. The keyboard musical instrument as set forth in claim 5, further comprising a silent system changed between a blocking position and a free position, said silent system causing said hammers to rebound thereon before striking said strings in said blocking position and to strike said strings in said free position.

7. The keyboard musical instrument as set forth in claim 6, further comprising an automatic playing system including actuators respectively associated with said manipulators and connected to said controller so as to be selectively energized for moving the associated manipulators without any fingering on said keyboard.

8. The keyboard musical instrument as set forth in claim 3, in which said attribute is the loudness of said electronic sound.

9. The keyboard musical instrument as set forth in claim 1, in which said sensors includes shutter plates respectively attached to said manipulators and moved along shutter trajectories and photo-interrupters respectively associated with said manipulators, producing optical beams across said shutter trajectories, respectively, and supplying positional signals respectively representative of current manipulator positions to said controller so that said controller determines said trajectories as series of current manipulator positions.

10. The keyboard musical instrument as set forth in claim 9, in which each of said positional signals varies a value representative of the intensity of non-interrupted optical beam between said rest position and said end position, and boundaries of said sections for one of said manipulators are defined by values of associated one of said positional signals given through a multiplication between a distance from said rest position to said end position and coefficients.

11. The keyboard musical instrument as set forth in claim 10, in which said coefficients are changeable.

12. An information processing system for categorizing a motion of a manipulator into one of predetermined kinds of motions, comprising:

a data storage means for storing first pieces of data information representative of values of a section velocity of manipulators of a musical instrument measured in sections of a space between rest positions of said manipulators and end positions of said manipulators; and a means for determining a motion of each of said manipulators to be categorized in one of kinds of motions on the basis of variation of said values of said section velocity.

13. The information processing system as set forth in claim 12, further comprising a means for determining a significant velocity for the motion of one of said manipulators categorized in one of said kinds of motions on the basis of a velocity of a first zone of said space, said velocity of said first zone being larger than a velocity of a second zone of said space for the motion categorized in another of said kinds.

* * * * *